US012268924B2

(12) United States Patent
Barbera

(10) Patent No.: US 12,268,924 B2
(45) Date of Patent: Apr. 8, 2025

(54) CORE EXERCISE DEVICE WITH GUIDE TRACK

(71) Applicant: Melvin A. Barbera, Liberty Towship, OH (US)

(72) Inventor: Melvin A. Barbera, Liberty Towship, OH (US)

( * ) Notice: Subject to any disclaimer, the term of this patent is extended or adjusted under 35 U.S.C. 154(b) by 94 days.

(21) Appl. No.: 18/112,570

(22) Filed: Feb. 22, 2023

(65) Prior Publication Data

US 2023/0271054 A1 Aug. 31, 2023

Related U.S. Application Data

(60) Provisional application No. 63/313,766, filed on Feb. 25, 2022.

(51) Int. Cl.

| | |
|---|---|
| ***A63B 21/00*** | (2006.01) |
| ***A63B 21/002*** | (2006.01) |
| ***A63B 23/02*** | (2006.01) |

(52) U.S. Cl.

CPC ..... *A63B 21/4033* (2015.10); *A63B 21/0023* (2013.01); *A63B 21/4045* (2015.10); *A63B 21/4049* (2015.10); *A63B 23/0211* (2013.01); *A63B 2208/0295* (2013.01)

(58) Field of Classification Search

CPC ..... A63B 21/0023; A63B 21/4033; A63B 21/4035; A63B 21/4045; A63B 21/4049; A63B 22/205; A63B 23/0211; A63B 2208/0295; A63B 2208/0219

See application file for complete search history.

(56) References Cited

U.S. PATENT DOCUMENTS

| | | | | |
|---|---|---|---|---|
| 8,088,052 | B1 | 1/2012 | Sprague | |
| 8,353,808 | B1 * | 1/2013 | Barney | A63B 23/0355 482/141 |
| 9,079,072 | B2 | 7/2015 | Agostini | |
| 9,216,321 | B2 | 12/2015 | Agostini | |
| 9,327,155 | B2 | 5/2016 | Doyle | |
| 9,539,465 | B2 | 1/2017 | Agostini | |
| 9,878,199 | B2 | 1/2018 | Agostini | |

(Continued)

OTHER PUBLICATIONS

International Search Report and Written Opinion dated Jul. 29, 2022 for Application No. PCT/US22/31704, 7 pages.

*Primary Examiner* — Megan Anderson

(74) *Attorney, Agent, or Firm* — Frost Brown Todd LLP

(57) ABSTRACT

An exercise device including a body engagement portion that can support a user, and a guide track assembly that can rotationally house the body engagement portion. The body engagement portion includes a base surface and a rotation support assembly. The base surface may support the user in a standard plank position. The body engagement portion may allow a user to rotate between a first side plank position, the standard plank position, and a second side plank position relative to a support surface while the guide track assembly remain in contact with the support surface and the body engagement portion support upper body of the user. The body engagement portion may allow a user to statically hold a plank position or rotate between two plank positions at any angle equal to, or between, the first side plank position, the standard plank position, and the second side plank position.

20 Claims, 17 Drawing Sheets

(56) References Cited

U.S. PATENT DOCUMENTS

| | | | | |
|---|---|---|---|---|
| 10,279,213 | B2 | 5/2019 | Agostini | |
| 10,507,359 | B1 | 12/2019 | Shubin Stein | |
| 10,583,321 | B2 | 3/2020 | Panes | |
| 11,324,997 | B2 | 5/2022 | Panes | |
| 11,844,979 | B2 | 12/2023 | Barbera | |
| 2007/0298947 | A1 | 12/2007 | Eksteen | |
| 2012/0010058 | A1 | 1/2012 | Sprague | |
| 2012/0252645 | A1* | 10/2012 | Agostini | A63B 22/18 482/132 |
| 2014/0011649 | A1 | 1/2014 | Carney | |
| 2015/0238795 | A1* | 8/2015 | Domesick | A63B 21/0023 482/142 |

* cited by examiner

CORE EXERCISE DEVICE WITH GUIDE TRACK

PRIORITY

This application claims priority to U.S. Provisional Application No. 63/313,766, entitled "Core Exercise Device with Guide Track," filed Feb. 25, 2022.

BACKGROUND

Core strength and conditioning of the abs, back, and glutes may be desired for various reasons, such as good posture, optimal physical performance, etc. Planks are an isometric core conditioning exercise that can be done to improve core strength and conditioning. A standard plank is an isometric exercise done by holding the body in a straight line from feet to head with the upper body elevated while supporting a substantial portion of bodyweight on the elbows or hands in a face-down position. Similarly, a side plank is done by holding the body in a straight line from feet to head with the upper body elevated; but is performed by supporting a substantial portion of bodyweight on one elbow or hand while facing a direction parallel to the floor. Generally, standard and side planks are done by statically holding the above-described positions for a period of time.

A variation of a plank involves placing the hands or elbows on an unstable surface, like a half sphere balance ball, in order to add a balancing component to increase the effort during a plank. Other devices have been used to add a balancing component to the plank position.

While a variety of exercise devices for the core have been made and used, it is believed that no one prior to the inventor has made or used an invention as described herein.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

Figure 1:
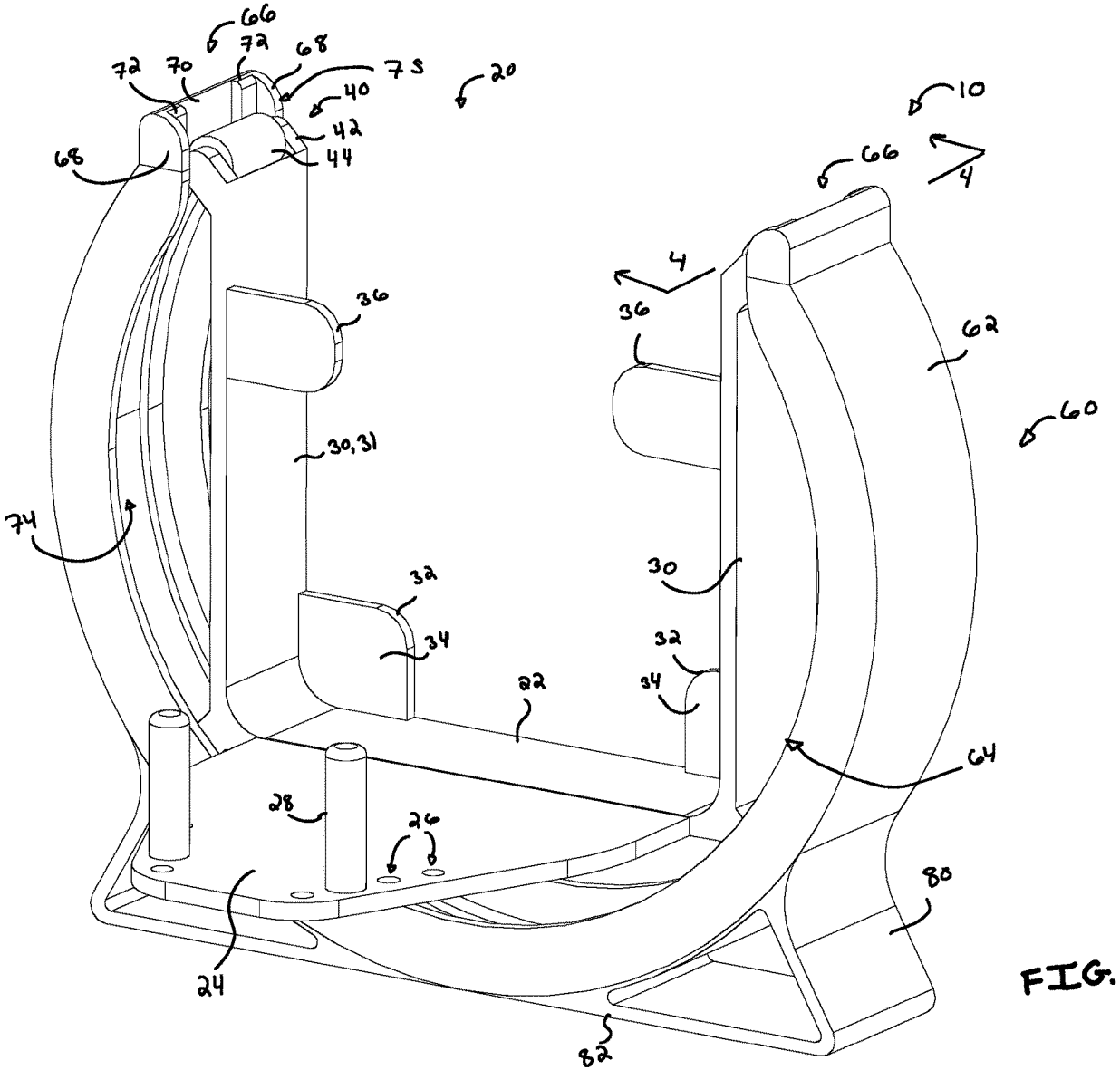
FIG. 1 depicts a perspective view of an illustrative core exercise device including a body engagement portion and a guide track assembly.
Figure 2:
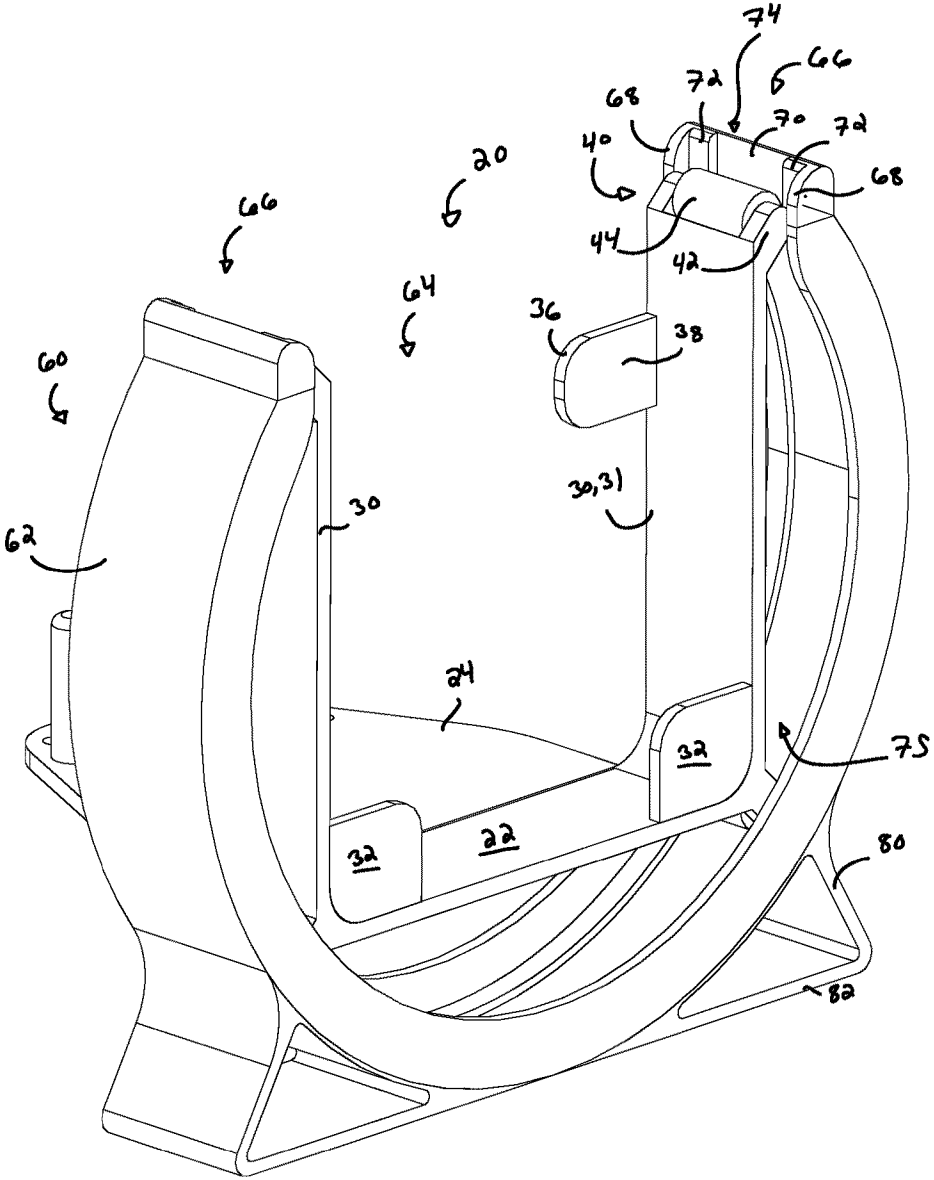
FIG. 2 depicts another perspective view of the core exercise device of FIG. 1.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

I. Illustrative Core Exercise Device

As mentioned above, the standard plank involves a person supporting a substantial portion of their bodyweight in a face-down position (i.e., facing in a direction perpendicular with the floor), while the side plank involves a person supporting a substantial portion of their bodyweight while facing a direction parallel to the floor. In some instances, it may be desirable for a person to perform an isometric plank at rotational positions between, and including, the standard plank and the side plank. This may allow a person to exercise and condition certain portions of their core to a greater degree as compared to standard and side planks. Therefore, it may be desirable to have a device that provides the option of unlimited isometric positions; including the standard frontal plank, each of the full side planks, and a plank at any angle in-between. Such a device may allow a person to rotate into a desired angle and hold that plank position for a suitable period of time. This may also add a balancing component to achieving such isometric positions.

As also mentioned above, there are devices used to add a balancing component while a person holds the plank position, thereby allowing that person to slightly pivot about their long axis while maintaining the isometric, standard plank position. In such balancing exercises, the person's weight may shift laterally relative to the portion of the device in contact with the ground, thereby adding the balancing component of the exercise. In some instances, rather than merely providing a balancing component with a lateral shift/tilting in weight as described above, it may be desirable to provide a piece of exercise equipment that provides a person with the ability of isotonic dynamic planking by continuously rotating from one side plank position to the other side plank position (or between any other desirable planking positions as would be apparent to one skilled in the art in view of the teachings herein).

FIGS. 1-4 shows an illustrative core exercise device (10). Core exercise device (10) includes a body engagement portion (20) and a guide track assembly (60). Core exercise device (10) may be formed of any suitable material as would be apparent to one skilled in the art in view of the teachings herein. For example, core exercise device (10) may be formed of wood, metal, plastic, elastomeric material, inflatable material, or a combination thereof. In some instances, core exercise device (10) may be assembled such that no parts are configured to selectively decouple with each other.

As will be described in greater detail below, core exercise device (10) is configured to allow a person to perform an isometric standard plank (see FIG. 10), either isometric side plank (see FIGS. 12-13), or any other suitable isometric plank position between either side plank (see, for example, FIG. 11) as would be apparent to one skilled in the art in view of the teachings herein. Additionally, as will be described in greater detail below, core exercise device (10) is configured to provide isotonic dynamic planking by allowing a person to continuously rotate from one side plank position to the other side plank position (or from any suitable planking position to any other suitable planking position as would be apparent to one skilled in the art in view of the teachings herein).

A. Illustrative Body Engagement Portion

Body engagement portion (20) includes a base surface (22), two upwardly extending frame members (30) connected to lateral sides of base surface (22), a forearm support extension (24), two adjustable grips (28), two elbow pads (32) extending laterally inward from a respective frame member (30), two shoulder pads (36) extending laterally inward from a respective frame member (30), and a plurality of rotational support assemblies (40). As will be described in greater detail below, a person may engage suitable portions of body engagement portion (20) such that (A) the person may achieve the anatomical position relative to device (10) associated with a standard plank (e.g., see FIG. 14), and (B) the person may suitably control device (10) in accordance with the teachings herein to achieve various other planking positions (e.g., see FIGS. 11-13). As will also be described in greater detail below, rotation support assemblies (40) are configured to suitably engage selected portions of guide track assembly (60) in order to allow a person to rotate with body engagement portion (20) relative to guide track assembly (60) into various plank positions.

Figure 14:
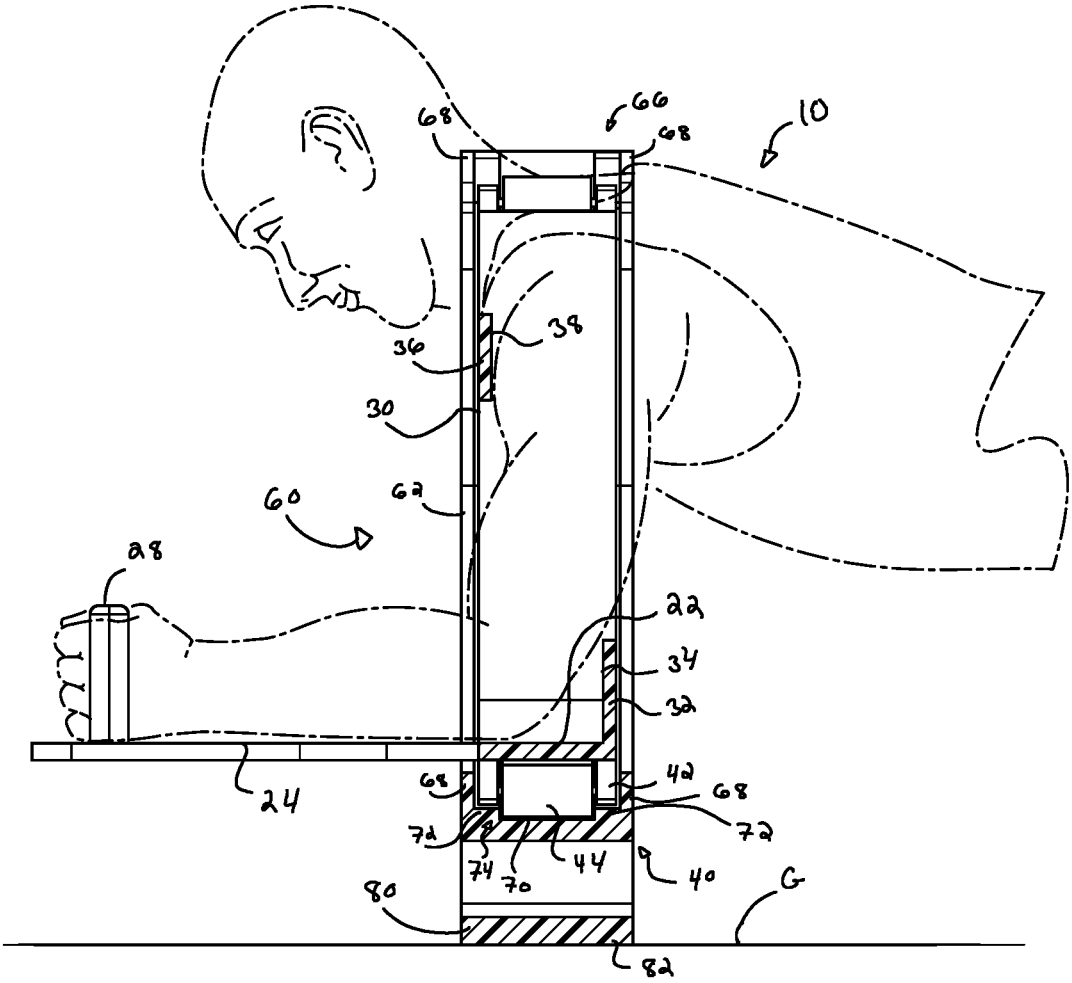
FIG. 14 depicts a cross-sectional view of the user of FIG. 10 engaged with the core exercise device of FIG. 1 in the standard plank position, taken along line 14-14 of FIG. 10.

As best shown in FIG. 14, base surface (22) is dimensioned such that a person may rest a portion of their forearms closest to their elbows on base surface (22); while forearm support extension (24) extends longitudinally away from base surface (22) such that the person may rest the portion of their forearms closest to their hand on forearm support extension (24). Therefore, base surface (22) and forearm support extension (24) are configured to provide a surface for a person to rest their forearms while suitably engaging device (10). In other words, a person may support a substantial portion of bodyweight on their elbows/forearms by placing their elbows and forearms on base surface (22) and forearm support extension (24).

Figure 11:
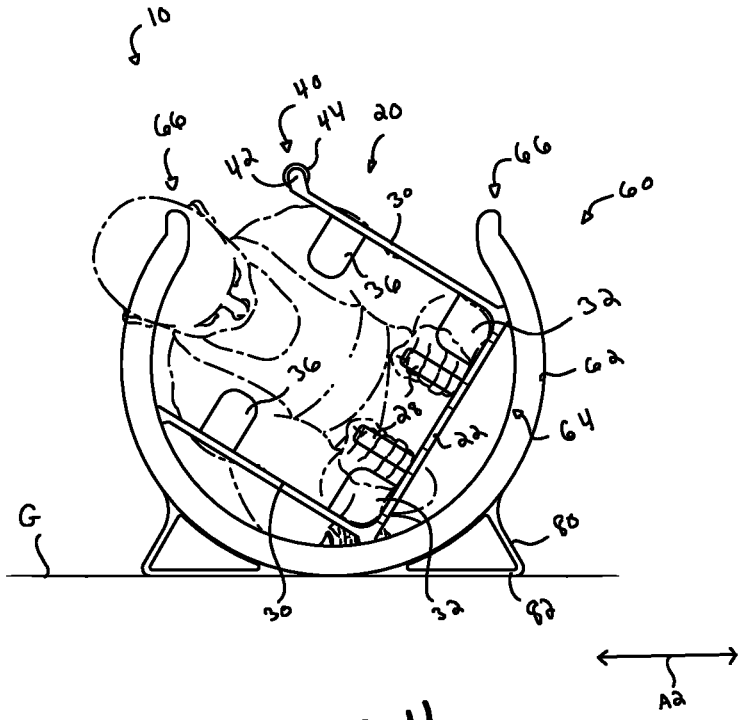
FIG. 11 depicts a front elevational view of the user of FIG. 10 engaged with the core exercise device of FIG. 1, where the user rotates the core exercise device from the standard plank position into a partial-side plank position.
Figure 12:
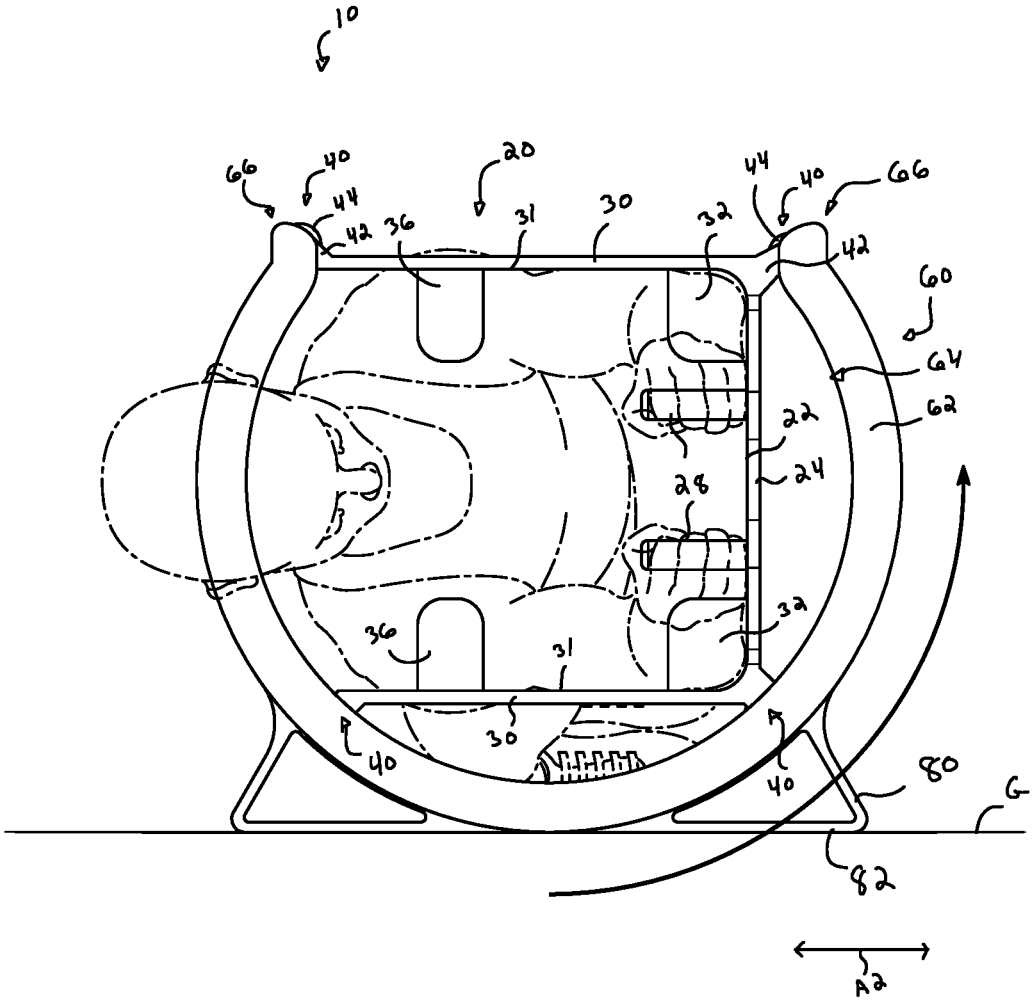
FIG. 12 depicts a front elevational view of the user of FIG. 10 engaged with the core exercise device of FIG. 1, where the user rotates with the core exercise device from the partial-side plank into a right-side plank position.
Figure 13:
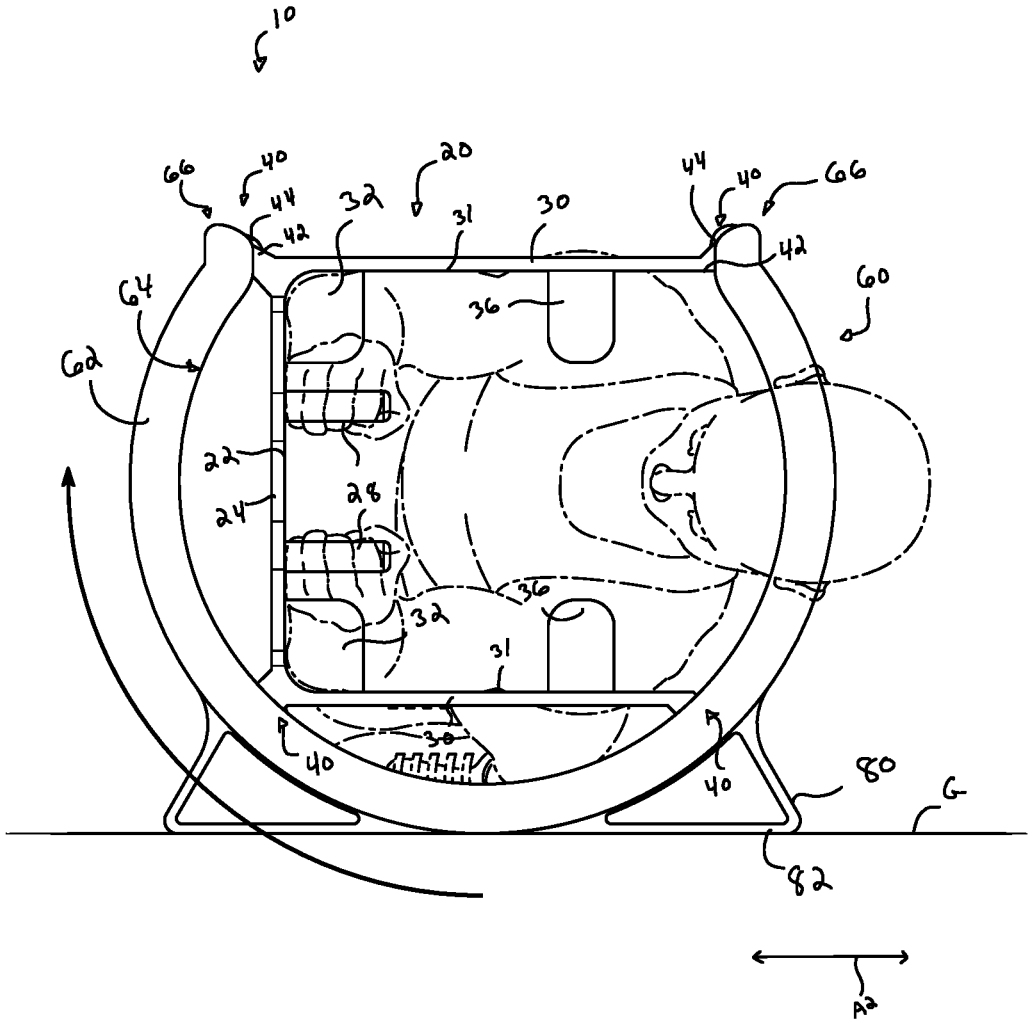
FIG. 13 depicts a front elevational view of the user of FIG. 10 engaged with the core exercise device of FIG. 1, where the user rotates with the core exercise device from the right-side plank position into a left-side plank position.

Upwardly extending frame members (30) each include an interior surface (31). Turning back to FIG. 5, interior surfaces (31) and base surface (22) together define a U-shaped opening dimensioned to receive a person's upper body such that the person may control device (10) via body engagement portion (20) in accordance with the description herein. As best shown in FIGS. 11-13, interior surfaces (31) are configured to abut against an upper arm of a person in order to support the person in a side plank position or partial side plank position.

Adjustable grips (28) extend upwardly from forearm support extension (24) in order to provide an object for a person to grasp with their hands while using device (10). Therefore, a person may control forearm support extension (24) via grips (28), while in the position shown in FIG. 14, to further control device (10) during illustrative use in accordance with the teachings herein. Grips (28) may include any suitable features as would be apparent to one skilled in the art in view of the teachings herein.

Elbow pads (32) each include an elbow contact surface (34); while shoulder pads (36) each include a shoulder contact surface (38). Elbow contact surfaces (34) and shoulder contact surfaces (38) extend laterally inward from respective frame members (30) and face each other in the longitudinal direction (A1) (see FIG. 14). As best shown in FIG. 14, a person may place their upper arms between respective surfaces (34, 38) such that elbows abut against elbow contact surface (34) while shoulders abut against shoulder contact surface (38). The gap between respective pads (32, 36) in the longitudinal direction (A1) may be suitable to allow a person to achieve the standard planking position shown in FIG. 14. Contact between shoulders and shoulder pads (36) and contact between elbows and elbow pads (32) may allow a person to effectively control and stabilize the positioning of device (10) during illustrative use in accordance with the description herein. Further, a person may pull on adjustable grips (28) to further promote contact between shoulders and shoulder pads (36) in order to allow a person to control and stabilize the position of device (10) in accordance with the teachings herein. In other words, pulling on grips (28) may promote firm contact on surfaces (34, 38) for optimal control of device (10).

In some instances, it may be desirable to adjust the position and/or replace the various features of body engagement portion (20) relative to other features of device (10) in order to suitably accommodate various user preferences and/or anatomical dimensions. As one example, the length of various user's forearms may deviate such that the length between adjustable grips (28) and elbow contact surfaces (34) in the longitudinal direction (A1) may need adjustments for various users to properly engage device (10) while forming the standard plank position. As another example, the dimensions of users' upper arms may deviate in length and thickness such that the distance between elbow contact surfaces (34) and shoulder contact surfaces (38) in the vertical and the longitudinal direction may need adjustment for different users to properly engage device (10) while forming the standard plank position. Therefore, grips (28), elbow pads (32), and/or shoulder pads (36), may be customizable in size and location.

Shoulder pad (36) may be configured to selectively couple with suitable locations of a respective upwardly extending frame member (30), such that shoulder pads (36) may be adjustable and/or replaceable to facilitate the anatomical dimensions of a user. Therefore, respective frame member (30) and shoulder pad (36) may have complementary features to promote selectively coupling with each other. Any suitable coupling features may be utilized as would be apparent to one skilled in the art in view of the teachings herein. For example, shoulder pad (36) may include a dovetail projection while interior surfaces (31) may define a slot dimensioned to receive the dovetail projection.

In some instances, shoulder pad (36) may be configured to rotate into various rotational positions relative to a respective frame member (30) about an axis that is parallel with lateral direction (A2) (see FIGS. 10-13). In some aspects of the disclosure, shoulder pads (36) are not configured to rotate (i.e., non-rotational) during illustrative use in accordance with the description herein. In some aspects of the disclosure, shoulder pads (36) are configured to remain firmly attached to surface (31) during illustrative use in accordance with the description herein. In some aspects of the disclosure, the position of shoulder pad (36) on surface (31) may be selectively adjustable while remaining non-rotational during illustrative use in accordance with the description herein.

In some instances, device (10) may come with multiple size shoulder pads (36) dimensioned with different heights and thicknesses. Therefore, a user may select a specific pair of shoulder pads (36) that allow for the specific user to suitably engage shoulder pads (36) and elbow pads (32), thereby allowing the user to suitably control device (10) while maintaining a proper plank position in accordance with the teachings herein.

In some instances, shoulder pads (36) may have additional pads that may be selectively attached to shoulder contact surface (38), thereby allowing a user to change the longitudinal distance between shoulder contact surface (38) and elbow contact surface (34). The additional pads may selectively attach to shoulder contact surface (38) of shoulder pad (36) via any suitable manner as would be apparent to one skilled in the art in view of the teachings herein. For instance, additional pads may include elastic bands that may wrap around the first shoulder pad (36) in order to couple together. Alternatively, additional pads may selectively couple with first shoulder pad (36) via a hook and loop fastener system. Of course, these additional pads may be configured to couple with elbow pads (32) in alternative to, or in addition to, coupling with shoulder pads (36). Additional pads may also be configured to attach to base surface (22), forearm support extension (24), and/or interior surfaces (31) to adjust for the specific size of a user.

In some aspects of the disclosure, elbow pads (32) may also be adjustable in a similar fashion to shoulder pads (36) described herein. In some aspects of the disclosure, elbow pads (32) may be adjustable relative to interior surfaces (31) and/or base surface (22) via any suitable means as would be apparent to one skilled in the art in view of the teachings herein. In some instances, elbow pads (32) may be adjustable relative to base surface (22) and/or upwardly extending frame members (30). Any suitable means of coupling elbow pads (32) with base surface (22) and upwardly extending frame members (30) may be utilized as would be apparent to one skilled in the art in view of the teachings herein.

As mentioned above, forearm support extension (24) extends longitudinally away from base surface (22) such that the person may rest the portion of their forearms closest to their hand on forearm support extension (24). In some instances, forearm support extension (24) may be fixedly attached to base surface (22). In other instances, forearm support extension (24) may be adjustable longitudinally and/or laterally relative to the base surface (22). In some instances, forearm support extension (24) may be adjustable in length along the longitudinal direction (A1) or the lateral direction (A2) relative to base surface (22). In some instances, various forearm support extensions (24) having different lengths, widths, and/or heights may be used and selectively attached to base surface (22), according to the needs of the specific user. In some aspects of the disclosure, forearm support extension (24) may be pivotally attached to base surface (22) via hinge such that forearm support extension (24) may be folded-up for storage and/or locked into place during illustrative use. Forearm support extension (24) may be pivotally attached to base surface (22) via any suitable means as would be apparent to one skilled in the art in view of the teachings herein.

Forearm support extension (24) defines two longitudinal arrays of grip receiving openings (26). Adjustable grips (28) may selectively couple with forearm support extension (24) via grip receiving openings (26) in similar fashion to shoulder pad coupling and shoulder pads (36) described above. Since grips (28) may selectively attach to forearm support extension (24) at various locations along the longitudinal direction (A1), users may customize the length between grips (28) and elbow pad (32) to accommodate for their specific forearm length, thereby allowing the user to use device (10) in accordance with the description herein.

It should be understood that any other suitable structures may be used in order to allow grips (28) to selectively couple with forearm support extension (24) as would be apparent to one skilled in the art in view of the teachings herein. As one example, grips (28) and openings (26) may be configured to couple with each other via a threaded screw-in assembly. In some aspects of the disclosure, grips (28) may be slidably coupled to elongated slots defined by forearm support extension (24), instead of using openings (26) forming a pair of arrays. Therefore, a user may simply slide grips (28) along a path defined by slots in order to suitably locate grips (28) on forearm support extension (24). In such aspects, grips (28) may be slidably attached to respective slots via a circular dovetail extension and complementary slot, thereby enabling grips (28) to rotate about their own axis without dissociating from forearm support extension (24).

In some aspects of the disclosure, a distal end of forearm support extension (24) may be modified to be grasped by a user during illustrative use in accordance with the description herein such that grips (28) are unnecessary. In such aspects of the disclosure, the distal end of forearm support extension (24) may include undulating features to further promote grasping the distal end of forearm support extension (24). In some aspects of the disclosure, a laterally extending grasping bar may extend from forearm support extension (24); which may also be selectively adjustable relative to forearm support extension (24). Any suitable structures may be incorporated to promote grasping of device (10) as would be apparent to one skilled in the art in view of the teachings herein. Of course, in some aspects of the disclosure, grips (28) and/or alternative grasping structures may be entirely omitted.

In some instances, forearm support extension (24) may include features for selectively receiving an electronics device. For example, forearm support extension (24) may define a device receiving pocket configured to receive a cell phone, tablet, television, book, or other device as would be apparent to one skilled in the art in view of the teachings herein. Therefore, in some instances, a user may view the device contained in the device receiving pocket while exercising on device (10) itself. In some instances, when an electronic device is housed within such a pocket, such an electrical device may include an application that is programed to interact with the motion of the present device (10), thereby adding variety and additional challenges to an exercise routine.

Any other suitable means may be used to secure electronic device to forearm support extension (24) as would be apparent to one skilled in the art in view of the teachings herein. For example, stretchable silicone straps configured to stretch and engage the corners of any sized device may be used to secure electronic devices to forearm support extension (24). Such stretchable silicone straps may be attached to a rotating base that allows for electronic device to be adjusted between portrait and landscape viewing. In some instances, electronic devices may be integrated into, or otherwise operatively incorporated into, forearm support extension (24) and/or any other suitable components of device (10) as would be apparent to one skilled in the art in view of the teachings herein. As one illustrative example, an interactive touch screen may be fixed to forearm support extension (24). Electronic devices having screens may be utilized to view videos (e.g. television, movies, etc.) and/or suitable interactive material.

In some aspects of the disclosure, grips (28) may be equipped with wired and/or wireless connectivity in order to establish electrical communication with electronic devices secured to forearm support extension (24). Grips (28) may include various control features to thereby provide additional control over interactive software on the electronic devices. Such control features may include buttons, joy-stick capabilities, capacitive touch sensors, or any other suitable control features as would be apparent to one skilled in the art in view of the teachings herein.

As mentioned above, rotation support assemblies (40) are configured to suitably engage selected portions of guide track assembly (60) in order to allow a person to rotate with body engagement portion (20) relative to guide track assembly (60) into various plank positions. Therefore, rotation support assemblies (40) are configured to allow a person to utilize their core to roll about their long axis between side plank positions (see FIGS. 12-13) and any other suitable plank positions in-between (see e.g., FIG. 11). Further, rotation support assemblies (40) are configured to allow a user to either maintain such a suitable plank position in an isometric position, allow the user to rotate between various planking positions in an isotonic dynamic planking fashion, or some combination of isometric and isotonic planking.

Figure 3:
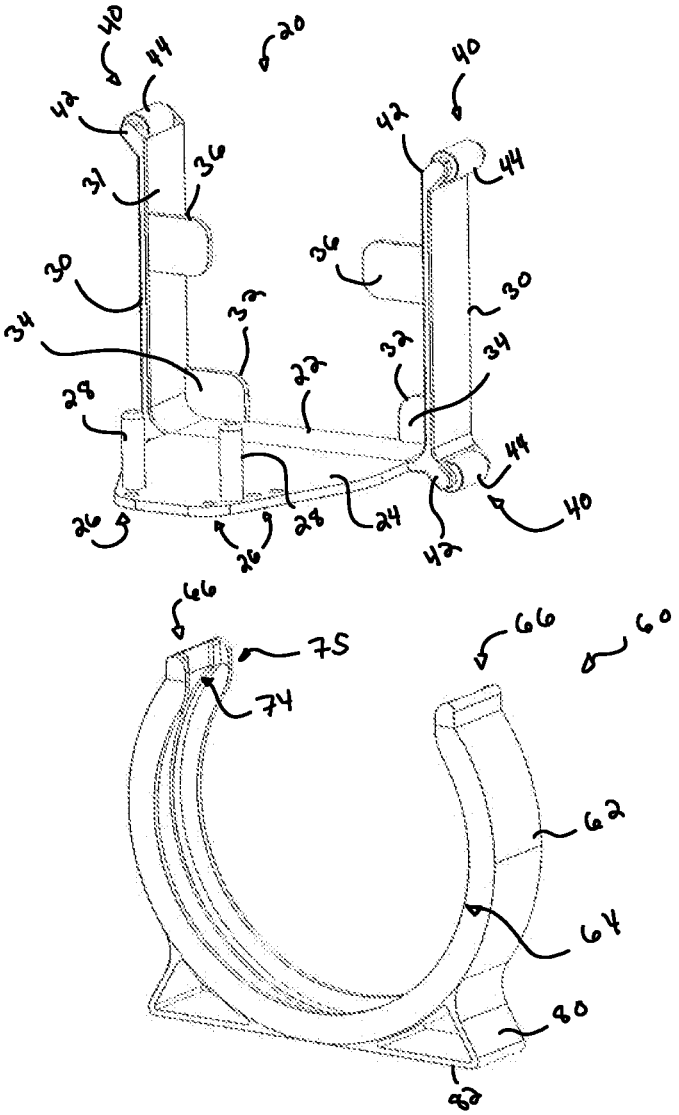
FIG. 3 depicts an exploded perspective view of the core exercise device of FIG. 1.
Figure 4:
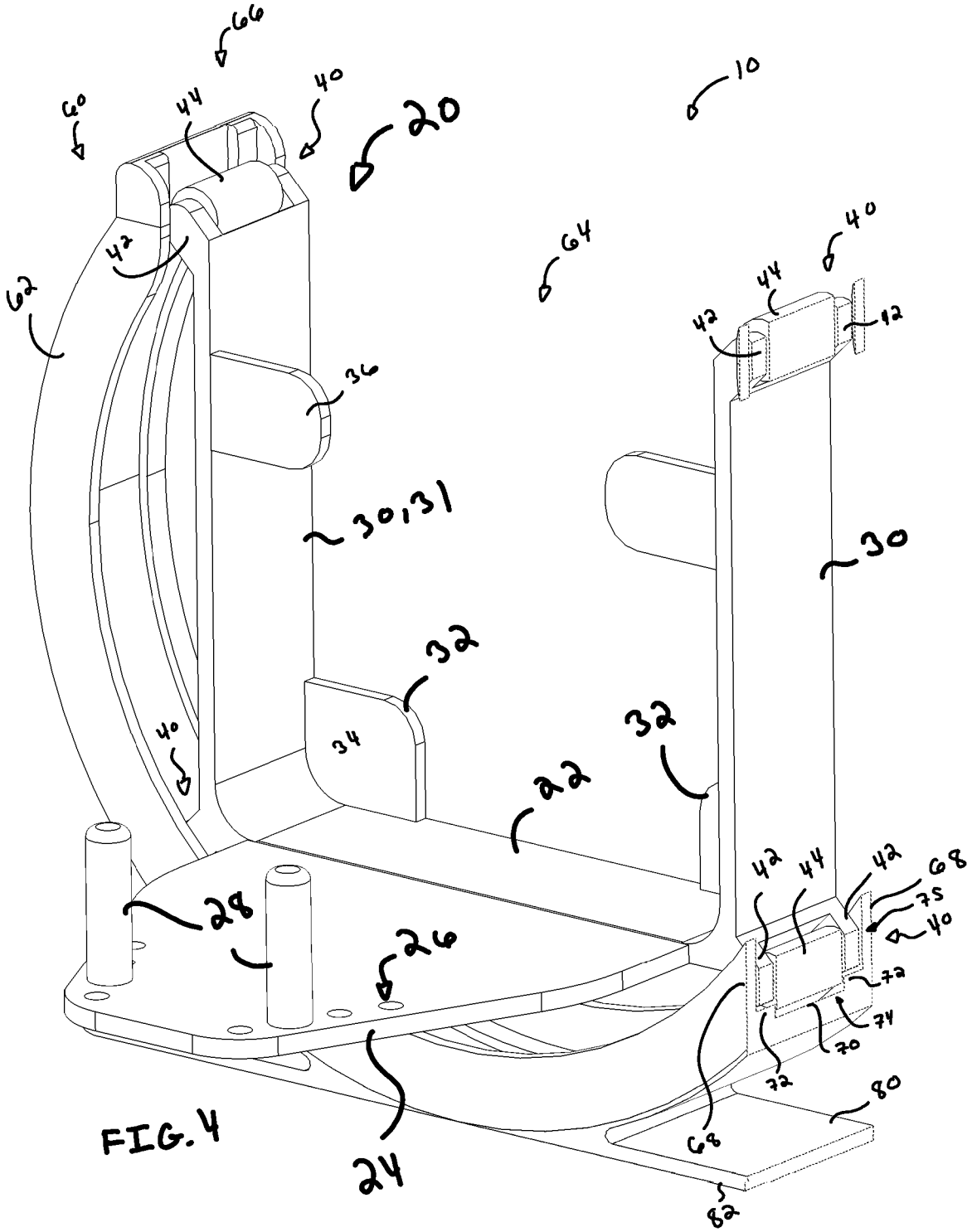
FIG. 4 depicts a sectional view of the core exercise device of FIG. 1, taken along line 4-4 of FIG. 1.
Figure 5:
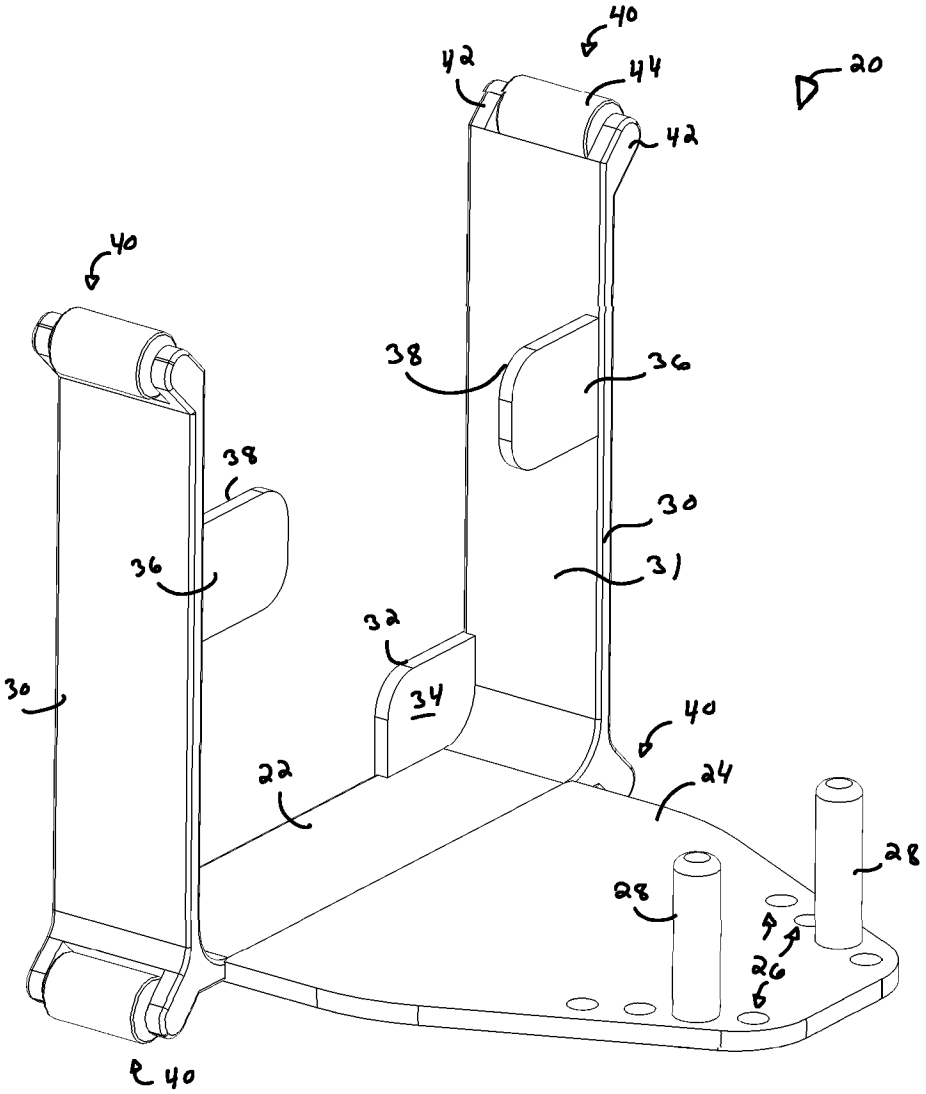
FIG. 5 depicts a perspective view of the body engagement portion of the core exercise device of FIG. 1.
Figure 6:
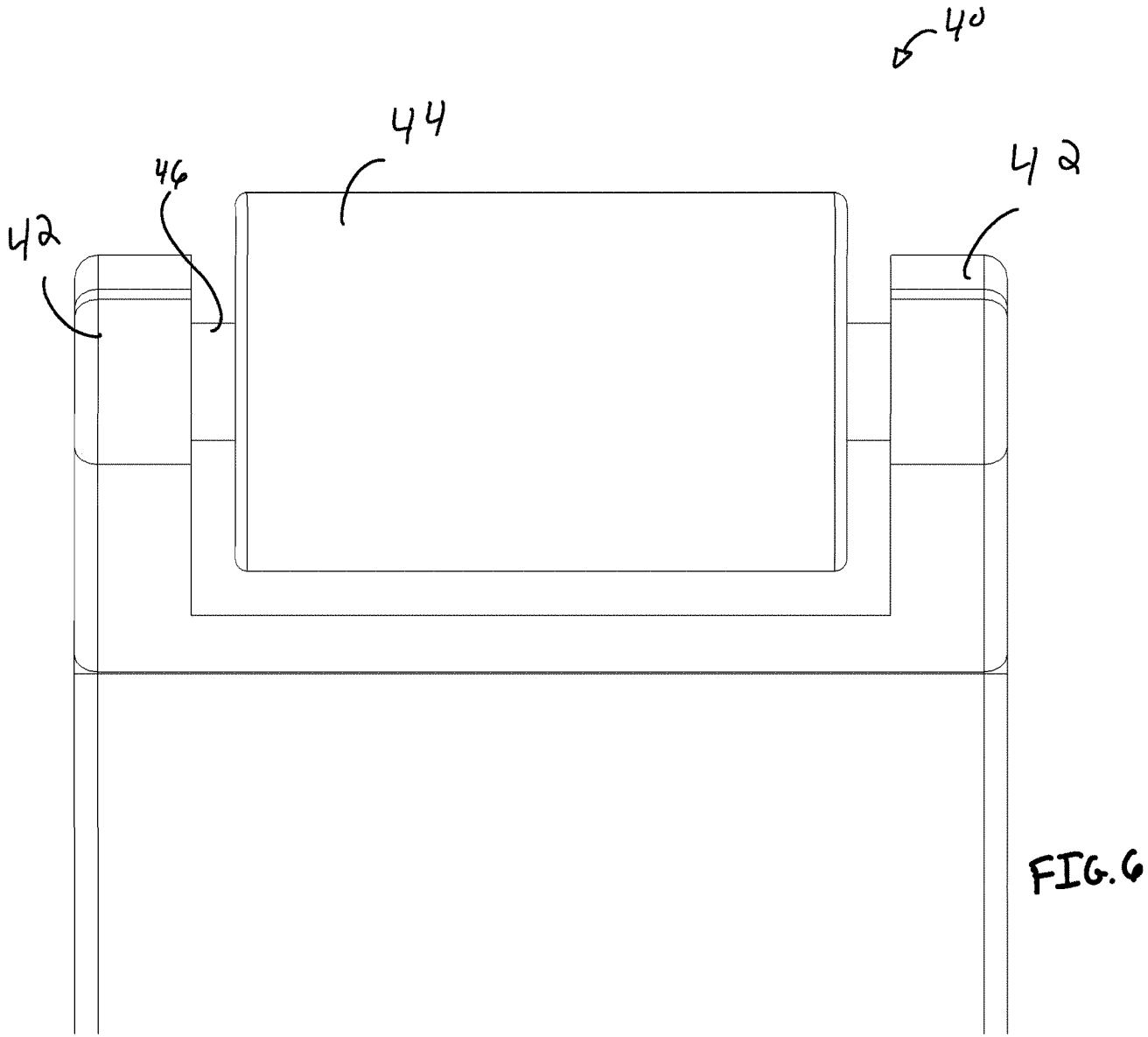
FIG. 6 depicts an elevational side view of a rotation support assembly of the body engagement portion of FIG. 1.
Figure 7:
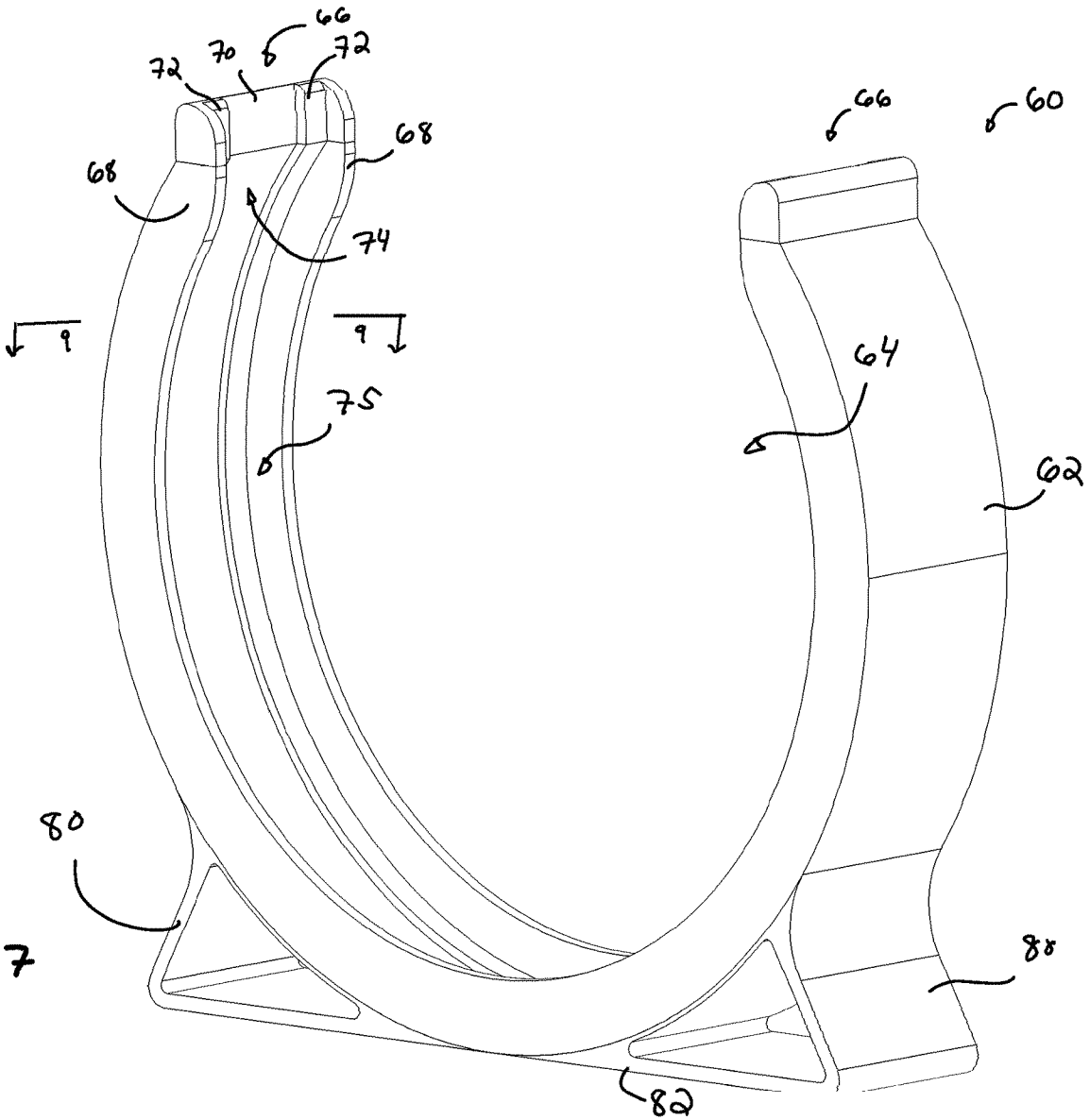
FIG. 7 depicts a perspective view of the guide track assembly of the core exercise device of FIG. 1.

Turning to FIGS. 3-5, a respective rotational support assembly (40) is located at terminal ends of upwardly extending frame members (30). As best shown in FIG. 6, each rotation support assembly (40) includes a yoke (42), a roller (44), and a roller coupling (46). Roller coupling (46) operatively attaches roller (44) with yoke (42) such that roller (44) may rotate about its own axis relative to yoke (42). Yoke (42) may be fixed relative to frame members (30) in order to suitably attach roller (44) with the rest of body engagement portion (20).

As shown in FIG. 4, rotation support assemblies (40) are housed within an arched pathway (75) defined by a curved body (62) of guide track assembly (60) such that rotation support assemblies (40) engage guide track assembly (60) to thereby operatively couple body engagement portion (20) with guide track assembly (60). Rotation support assemblies (40) are configured to engage suitable portions of curved body (62) such that a user may, while maintaining a plank position in accordance with the description herein, freely rotate body engagement portion (20) along a predefined path defined by arched pathway (75) to achieve various planking positions. In particular, roller (44) suitably contacts select portions of curved body (62) in order to promote rotational movement between body engagement portion (20) and guide track assembly (60) in accordance with the description herein.

In some instances, roller (44) may be biased into contact with selective portion of curved body (62) defining arched pathway (75) (such as a roller floor (70)). Roller (44) may be biased into engagement with curved body (62) utilizing any suitable features as would be apparent to one skilled in the art in view of the teachings herein. For example, roller (44) and/or yoke (42) may be spring loaded relative to frame members (30) into engagement with a roller floor (70) of curved body (62).

While a roller (44) is used in the current example, roller (44) may include any suitable features and/or structures to achieve such rotational movement between body engagement portion (20) and guide track assembly (60). For example, roller (44) may include a roller bearing, ball bearing, a low friction surface, lubricant etc. In some examples roller (44) may include a body that does not necessarily roll, but includes a low friction surface operable to promote sliding between the low friction surface and roller floor (70) to thereby enable rotation of body engagement portion (20) relative to guide track assembly (60). In some examples, upwardly extending frames (30) may include a curved body which is complementary to arched pathway (75). Upwardly extending frame (30) may include the low friction surface and/or lubricant configured to slidably engage roller floor (70) housed within arched pathway (75) of curved body (62) to thereby promote rotation between body engagement portion (20) and guide track assembly (60).

While four rotation support assemblies (40) are shown in the current example, any suitable number of rotational support assemblies (40) may be utilized as would be apparent to one skilled in the art in view of the teachings herein. For example, in instances where upwardly extending frames (30) include a complementary curve as described above, an array of rollers (44) may be located along the profile of frame (30), where each roller (44) in the array suitably engages roller floor (70) to thereby promote rotation between body engagement portion (20) and guide track assembly (60).

Forearm support extension (24), grips (28), interior surface (31), elbow pads (32), and/or shoulder pads (36), may be further constructed and operable in accordance with any of the teachings U.S. patent application Ser. No. 17/568,760, entitled "Core Exercise Device," filed Jan. 5, 2022, the disclosure of which are incorporated by reference herein.

In some instances, body engagement portion (20) may have a support element to help support the back of the user. In some instances, body engagement portion (20) may be equal to, or wider than the minimum width needed for comfortable support of elbows, arms, and shoulders.

In some instances, pads (32, 36) and/or surfaces (22, 31) may be inflatable. In some instances, pads (32, 36) and/or surfaces (22, 31) may be inflatable to be adjusted to fit difference sized users.

In some instances, device (10) may include elbow, arm, and shoulder restraints rather than just surfaces (22, 34, 38, 31). In such instances, sleeves, straps, custom fit molded supports, other support pad arrangement, inflatable restraints, and the like may be used.

In some instances, no elbow, arm, and/or shoulder restraints may be needed in examples where comfort, balance, and a snug fit provide sufficient control of device (10), such as when, but not limited to, device (10) or select portions of device (10) are an inflatable unit.

In some instances, all or various features of body engagement portion (20) may be inflatable such that inflation would provide adjustment of body size fitting.

In some instances, body engagement portion (20) may have adjustments designed to keep the user's body at the center of rotation of device (10) (e.g., the axis which device (10) rotates as seen from the view in FIGS. 10-13).

In some instances, body engagement portion (20) may be designed in various configurations to comfortably hold the upper body.

B. Illustrative Guide Track Assembly

As described above, body engagement portion (20) allows a user to suitably control device (10) while achieving the anatomical positioning of the standard plank. As also mentioned above, body engagement portion (20) is configured to rotate along a path defined by guide track assembly (60) such that a user may achieve various planking positions in accordance with the description herein. As will be described in greater detail below, guide track assembly (60) is configured to rotationally support body engagement portion (20) relative to the ground (G) to allow a user to engage in various suitable isometric plank positions between either side plank, while also allowing a person to continuously rotate from one side plank position to the other side plank position in an isotonic fashion (or from any other two desirable plank positions as would be apparent to one skilled in the art in view of the teachings herein).

As best shown in FIGS. 1-3 and 7, guide track assembly (60) includes a curved body (62) extending upwardly from a base body (80). Base body (80) includes a floor engagement surface (82) that is operable to rest on the ground (G) in order to suitably stabilize guide track assembly (60) during illustrative use of core exercise device (10) in accordance with the description herein. Floor engagement surface (82) and base body (80) may have any suitable dimensions as would be apparent to one skilled in the art in view of the teachings herein.

In some examples, base body (80) may have adjustment mechanisms configured to raise and/or lower curved body (62) vertically relative to the ground (G) while still suitably supporting curved body (62) in accordance with the teachings herein. Allowing a user to customize the vertical height of curved body (62) may allow to user to customize the height of their upper body compared to the ground (G) while utilizing device (10) in accordance with the description herein; which may affect the level of difficulty to perform isotonic and/or isometric planks. For instance, in a planking position, the more the upper body is elevated relative to the feet, less isometric strain occurs on the core muscles; the less the upper body is elevated relative to the feet, more isometric strain occurs on the core muscles.

Further, in some examples, a mechanical adjustment system may provide of curved body (62) to be "tipped" or rotated about a pivot relative to base body (80), in order to ensure curved body (62) extends along a plane that is perpendicular to the long axis of the user's body when in the plank position. This may facilitate easier rotation of the body engagement portion (20) as the user rotates into and out of various planking positions as would be apparent to one skilled in the art in view of the teachings herein. In addition to being adjustable relative to base body (80), a pivoting or flexible mounting could be used that automatically positions curved body (62) to extend along a plane that is perpendicular to the long axis of the user's body while in the planking position during illustrative use of device (10) in accordance with the description herein, Curved body (62) extends between a pair of insertion openings (66) to define a general U-shaped opening (64). General U-shaped opening (64) is dimensioned to receive both body engagement portion (20) and a portion of a person's upper body controlling body engagement portion (20). Curved body (62) also defines an arched pathway (75) dimensioned to suitably house rotation support assembly (40) to thereby allow for a user to utilize their core in order to transition between the various plank positions discussed herein. Arched pathway (75) acts as a track configured to guide body engagement portion (20) to rotate relative to guide track assembly (60) between various planking positions in a predictable manner.

As best shown in FIGS. 4 and 7-9, curved body (62) includes a pair a side flanges (68), a roller floor (70), and a pair of guide protrusions (72); each extending laterally in an arched profile to define arched pathway (75) between insertion openings (66). Rollers (44) are configured to engage roller floor (70) such that the contact between rollers (44) and roller floor (70) allows guide track assembly (60) to suitably support body engagement portion (20) in accordance with the description herein. Therefore, roller floor (70) may be configured to engage rollers (44) such that roller (44) may actuate relative to roller floor (70) along the arched pathway (75) to thereby allow body engagement portion (20) to rotate relative to guide track assembly (60) in a predictable manner.

Figure 9:
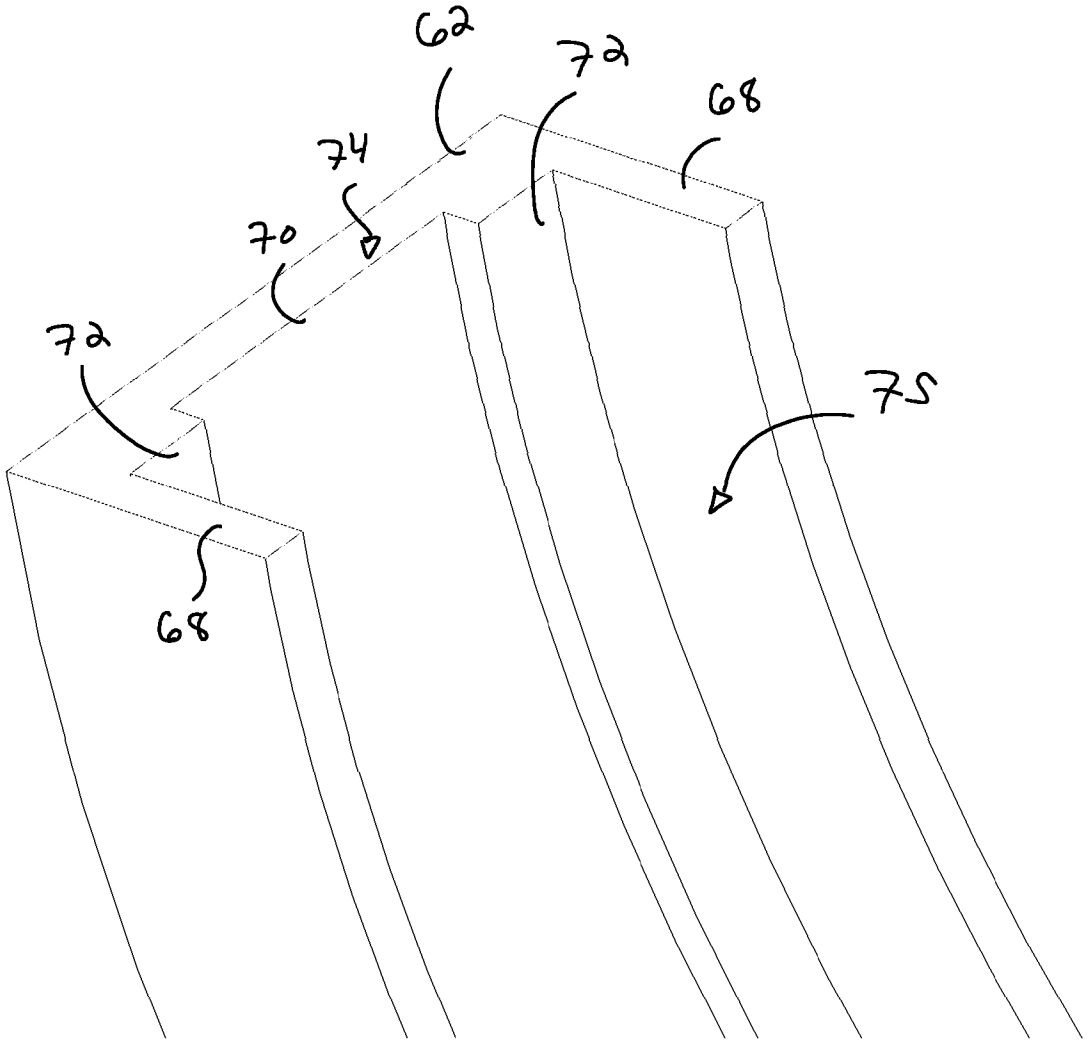
FIG. 9 depicts a sectional view of a curved body of the guide track assembly of FIG. 1, taken along line 9-9 of FIG. 7.

As best shown in FIGS. 4 and 9, roller floor (70) and guide protrusions (72) extend between side flanges (68); while a respective guide protrusion (72) is interposed between a roller floor (70) and a respective side flange (68). Side flanges (68) extend radially inward from both roller floor (70) and guide protrusions (72); while roller floor (70) faces radially inward with respect to arched pathway (75). As best shown in FIG. 4, yokes (42) are dimensioned with fit within the portion of arched pathway (75) directly adjacent to side flange (68) and guide protrusion (72). Therefore, yokes (42) may rotate along the predefined path defined by arched pathway (75) without significantly contacting curved body (62) and overly inhibiting rotation of body engagement portion (20) relative to guide track assembly (60).

Guide protrusions (72) extend upwardly from roller floor (70) such that guide protrusions (72) and roller floor (70) together define a roller recess (74). Roller recess (74) extends with arched pathway (75) and suitably contains rollers (44) to inhibit rollers (44) from translating in the longitudinal direction (A1) out of suitable engagement with roller floor (70). Therefore, guide protrusion (72) and roller floor (70) cooperate to ensure body engagement portion (20) rotates relative to guide track assembly (60) between various planking positions in a predictable manner.

The structure of, and relationship between, guide protrusions (72), roller floor (70), side flanges (68), and curved body (62) are merely illustrative such that rollers (74) and yoke (42) may be suitably contained within curved body (62) utilizing any suitable structures as would be apparent to one skilled in the art in view of the teachings herein. For example, in some instances, guide protrusions (72) may not be utilized if rollers (44) included a width that is substantially the same as the width of roller floor, and side flanges (68) had a length that were less than the radius of rollers (44), thereby allowing yokes (42) to rotate freely without contacting curved body (62) or side flanges (68).

Figure 8:
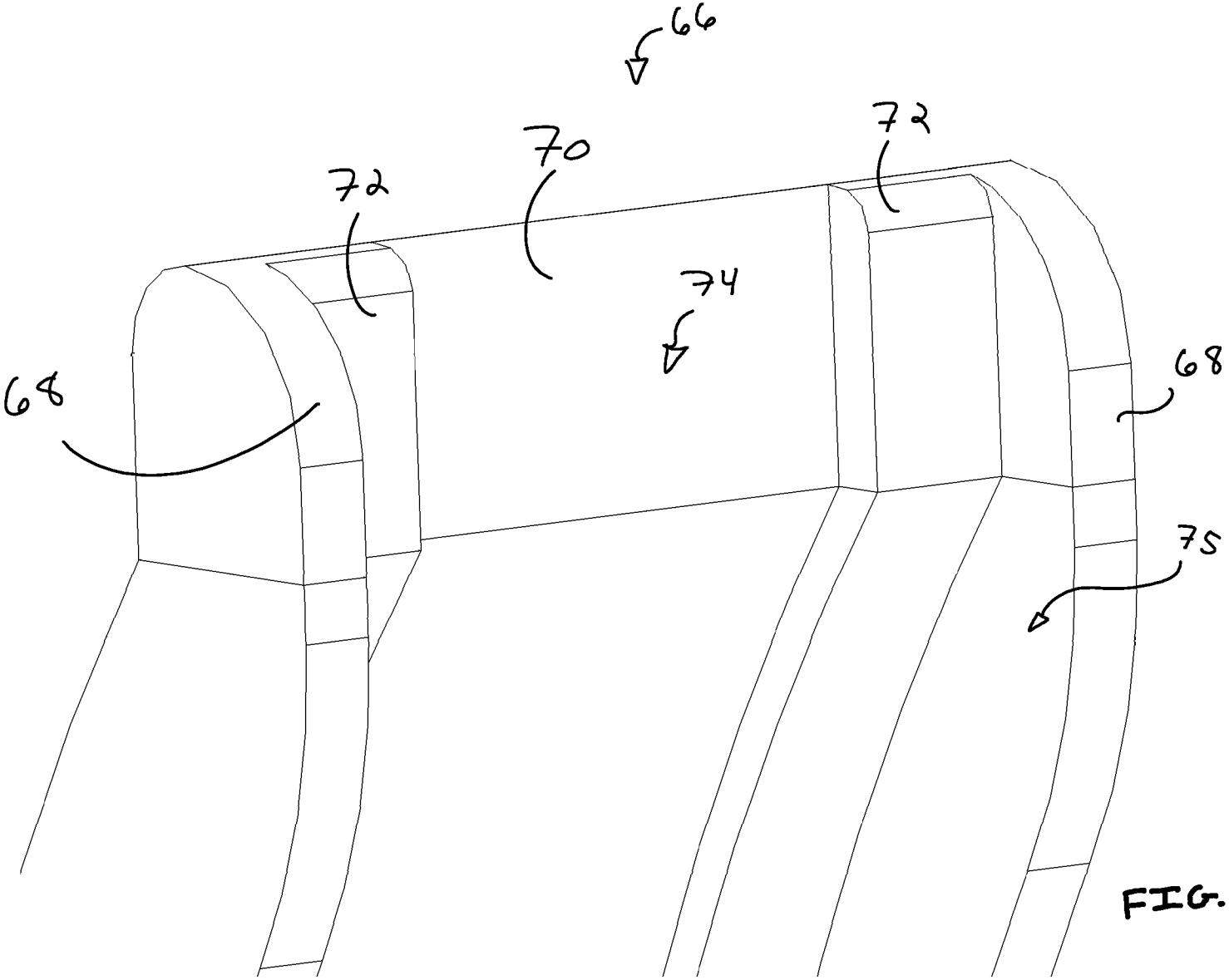
FIG. 8 depicts a perspective view of an insertion opening of the guide track assembly of FIG. 1.

Insertion openings (66) are in communication with arched pathway (75) such that rotation supports assembles (40) may suitably enter and exit arched pathway (75) as a user rotates body engagement portion (20) relative to guide track assembly (60) in accordance with the description herein. As best shown in FIG. 8, a portion of roller floor (70) and guide protrusions (72) forming insertion openings (66) extend vertically in a linear fashion. This portion of guide protrusion (72) and roller floor (70) provides an entrance and exit path for rotation support assembly (40). Therefore, if a user rotates body engagement portion (20) relative to guide track assembly (60) to a rotational position (see FIG. 11) where at least one rotation support assembly (40) is no longer in direct contact with roller floor (70), insertion openings (66) facilitate suitable re-engagement between rollers (44) and roller floor (70) when rotation support assembly (40) is rotated back into the confines of arched pathway (75).

In some instances, the portion of curved body (62) forming insertion openings (66) is resiliently flexible, such that as rotation support assembly (40) enters and/or exits insertion openings (60), that portion of curved body (62) resiliently flexes laterally outward to further accommodate such movement. In some instances, roller (44) may be spring loaded to accommodate entering and exiting of insertion openings (66). While insertion openings (66) are shown in the current example extending vertically upward, this is merely optional. Insertion openings (66) may be formed with any suitably geometry as would be apparent to one skilled in the art in view of the teachings herein. Further, in some instances, as will be described in greater detail below, insertion openings (66) may be entirely optional, as curved body (62) may form an arched pathway (75) having an annular loop.

As mentioned above, arched pathway (75) and rotation support assemblies (40) allows for the user to rotate with body engagement portion (20) between both side planks (see FIGS. 12-13). Therefore, the user of device (10) may rotate into various plank positions for isotonic exercise by utilizing their core to change the portion of roller floor (70) in contact with various rotation support assemblies (40). A user of device (10) may also hold various plank positions for isometric exercise.

It should be understood that the ground (G) may include any suitable support surface as would be apparent to one skilled in the art in view of the teachings herein. For instance, the ground (G) may include an elevated support surface configured to support base body (80); while another surface, either lower or higher relative to ground (G), may support the feet of a user. While in the current example, base body (80) is configured to directly engage ground (G) while a user utilizes device (10) to rotate between any suitable plank position as would be apparent to one skilled in the art in view of the teachings herein, this is merely optional.

In some instances, curved body (62) may be equal to, narrower, or wider than body engagement portion (20). In some aspects of the disclosure, roller floor (70) may have tactile feedback surfaces strategically placed along arched pathway (75) in order to provide targeted tactile feedback to the user. Such tactile feedback may be used for any suitable reason(s) as would be apparent to one skilled in the art in view of the teachings herein. In an aspect of the disclosure, tactile feedback surfaces may be located on roller floor (70) to indicate to a user that predefined plank angles have been achieved, such as a 30-degree angle, a 45-degree angle, a 60-degree angle, or any other suitable plank angle as would be apparent to one skilled in the art in view of the teachings herein. Such tactile feedback surfaces may be designed as to not interfere with full or partial isotonic rotation exercises, yet give the user tactile indication certain plank angles have been achieved. Such tactile feedback surfaces may include flat surface, bumps, ribs, etc. In an aspect of the disclosure, such tactile feedback surfaces may be selectively attachable and movable along arched pathway (75) or side flanges (68) such that a user may customize at what plank angles they receive such tactile feedback.

In some instances, guide track assembly (60) and/or user engagement portion (20) may be equipped with stops that prevent over-rotation of user engagement portion (20) relative to guide track assembly (60). Any suitable structure may be utilized in order to suitably prevent over-rotation as would be apparent to one having ordinary skill in the art in view of the teachings herein.

It should be understood that any suitable radius of curvature may be used for curved body (62) as would be apparent to one skilled in the art in view of the teachings herein. Additionally, the radius of curvature does not necessarily need to be uniform. In some instances, the radius of curvature may deviate along the length of arched pathway (75) in order to increase/decrease the difficulty of achieving various plank positions. For instance, such changes in the radius of arched pathway (75) may provide varying stress of isometric exercises and varying degrees of rotational effort for isotonic exercises. In such instances, rollers (44) may be spring loaded in order to maintain suitable contact with roller floor (70).

In some aspects of the disclosure, increased resistance to rotation may be added. For example, an adjustable friction element may be used to change the resistance to rotational movement, thereby changing the amount of muscle stress as desired by a user. Increased resistance to rotation may also be achieved by attaching weights to portions of upwardly extending frame members (30), which would increase resistance to rotation respectively. Additionally or alternately, elastic resistance bands may be attached to portions of upwardly extending frame members (30) and then attached to the ground such that rotation or device (10) between side planks would stretch one resistance band, thereby increasing resistance to achieving a side plank. Additionally or alternatively, increased resistance to rotation can be attached by attaching cable weights to portions of upwardly extending frame members (30).

In some instances, device (10) may include a flexible or elastic attachment(s) between curved body (62) and body engagement portion (20) such that the user is provided with a "springy" feel while using device (10) in accordance with the description herein.

In some instances, device (10) may include selected portions that are inflatable, or be entirely inflatable. Therefore, a user may inflate a device for illustrative use, then deflate the device for easier storage.

II. Illustrative Method of Use of Core Exercise Device

FIGS. 10-14 show an illustrative method of use of core exercise device (10) in order to achieve an isometric plank workout, as well as an isotonic plank workout. First, while optional, a user may customize device (10) for their specific anatomical dimensions in accordance with the description herein. Alternatively, device (10) may come in various sizes, such as small, medium, and large, in order to accommodate users with different anatomical dimensions.

Next, as shown in FIG. 14, a user may suitably engage body engagement portion (20) of core exercise device (10). Specifically, a user may place their upper arms such that their shoulders engage respective shoulder contact surfaces (38) and their elbows engage respective elbow contact surface (34). The user may also rest their forearms on a suitable portion of base surface (22) and forearm support extensions (24) while also grasping grips (28). Upper arms may be supported against respective interior surfaces (31). At this moment, the user has achieved the upper body anatomical positioning associated with a standard plank while also achieving suitable control of device (10) for achieving various planking positions in either isometric or isotonic fashion. In some instances, elbow pads (32) may be optional if firm grasping of grips (28) provides sufficient restriction of elbow movement when elbows are held against interior surface (31).

Figure 10:
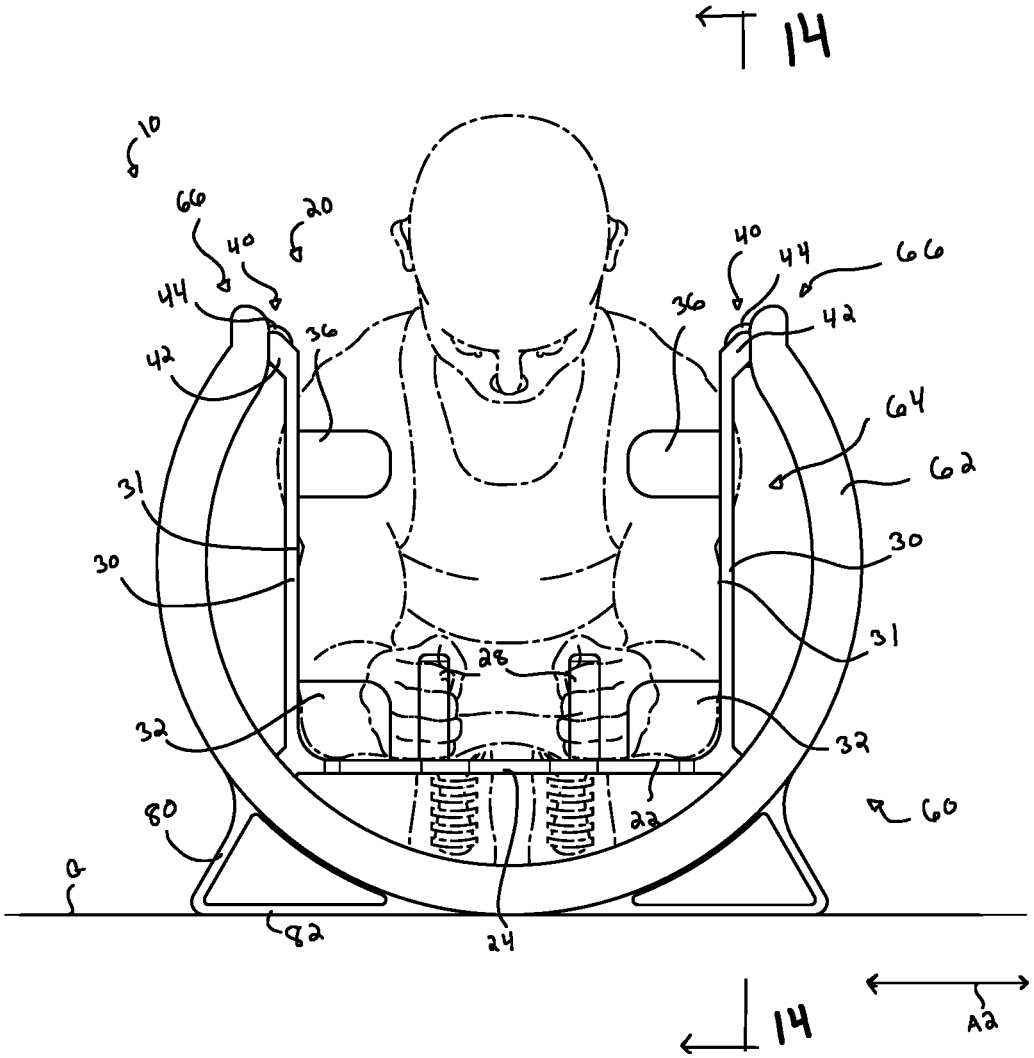
FIG. 10 depicts a front elevational view of a user engaged with the core exercise device of FIG. 1 in a standard plank position.

Next, as shown in FIG. 10, the user may place their feet on the ground (G) such that the only portions of their body touching the ground (G) are their feet, while base body (80) is also in contact with the floor. While utilizing their core muscles, the user may achieve a standard plank position as shown in FIG. 10. The user may place their feet wider apart or close together as compared to that shown in FIG. 10.

Since body engagement portion (20) is rotationally disposed within arched pathway (75) of guide track assembly (60), if the user desires to achieve a side plank position, the user may utilize their core to rotate themselves and body engagement portion (20) of device (10) into either side plank position shown in FIGS. 12-13. In order to achieve the side plank position, a rotation support assembly (40) may be required to exit a first insertion opening (66) (see FIG. 11) in order to enter the other insertion opening (66).

While in the side plank position, the user may have their upper arm located closest to the ground (G) abutting against the respective interior surface (31) of frame member (30) closest to the ground (G). It should be understood that the user may utilize their core to also rotate themselves to any suitable plank position between the side plank positions shown in FIGS. 12-13. While in the current side planks shown in FIG. 12-13, the user has their feet stacked on top of each other, the user may place their feet wider apart as compared to that shown in FIGS. 12-13 such that both feet maintain suitable contact with the ground (G). In such aspects, while utilizing their core to hold or rotate into the various plank position possible, a user may keep their feet at shoulder width or greater to provide a twisting of the shoulder relative to the hips and legs while performing both isometric and isotonic exercises. This type of positioning of the feet may help a user mimic the core rotation necessary for swinging a golf club, tennis racket, baseball bat, etc., all of which require rotation of the shoulders relative to the hips and legs.

It should be understood that for the many plank positions achievable between the side plank positions shown in FIGS. 12-13, a different portion of roller floor (70) will be in contact with rollers (44). Therefore, it should be understood that the user may utilize device (10) in order to rotate themselves as body engagement portion (20) into a virtually infinite number of plank positions between side planks. Having such capabilities may allow a user to exercise selected portions of their core to a greater degree as compared to a strictly standard or side plank.

Further, it should be understood that the user may isometrically hold each plank position for a suitable period of time in order to provide a suitable period of stress for the isometric exercise. Additionally, or alternatively, the user may provide rotational effort about their longitudinal axis in order to perform an isotonic dynamic plank between any two or more suitable planking positions, including side planks or planking positions between side planks. In other words, the user may utilize their core to generate the rotational movement required to controllably actuate the portion of rollers (44) that is in contact with roller floor (70), thereby controlling the rotational movement of their own body and device (10) about an axis extending parallel with the long axis of the user's body. This may force the core muscle group to dynamically work through the rotational range of motion. It should be understood that a mix of isometric pauses during isotonic rotation may provide a unique and highly beneficial exercise routine. It should be understood that while a user rotates between various plank positions in accordance with the description herein, base body (80) remains substantially stationary relative to the ground (G).

As mentioned above, a user may position their feet wider apart, closer together, stacked on top of each other, or any other suitable position as would be apparent to one skilled in the art in view of the teachings herein. In some aspects of the disclosure, additional accessories might include sliders for the feet to move smoothly when spreading the feet apart, moving the feet closer together, or pulling feet closer into a tuck position or pulling the body into a pike position. In some aspects of the disclosure, an accessory may be utilized to elevate the feet during illustrative use of device. In some aspects of the disclosure, a rotation device for the feet may also be incorporated that may allow the feet, while close to each other, to rotate freely in harmony with the body's rotation while using device (10) in accordance with the description herein.

III. Illustrative Core Exercise Device with Guide Track Assembly Forming Annular Loop In some instances, it may be desirable to keep rollers (44) into contact engagement with roller floor (70) rather than have a roller (44) temporarily disengaged with curved body (62), like shown in FIG. 11. Additionally, in some instances, it may be desirable to rotate body engagement portion (20) into a position that is rotationally past a side plank such that the back of a user at least temporarily may face in a direction at least partially facing the ground (G).

Figure 15:
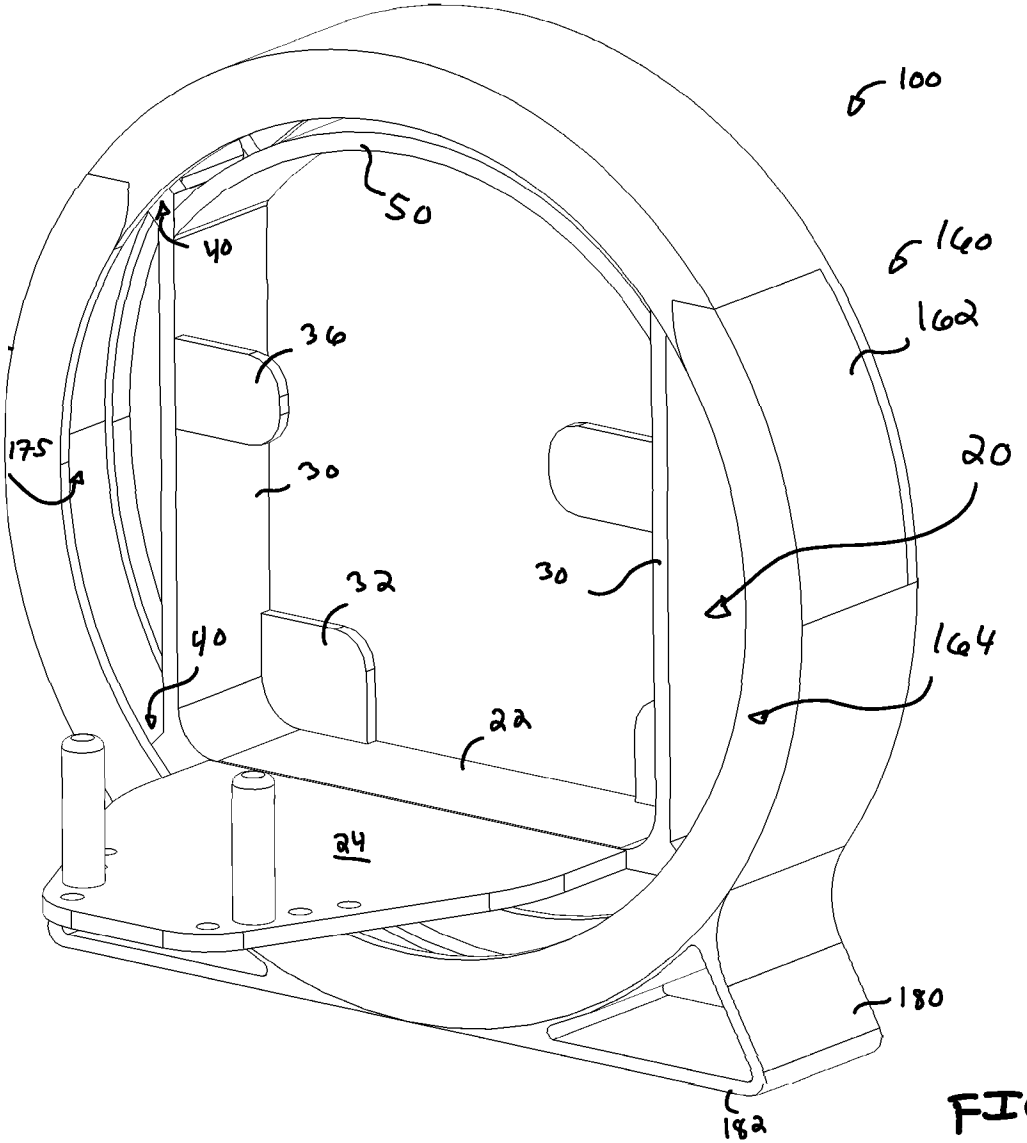
FIG. 15 depicts a perspective view of an alternative core exercise device.

FIG. 15 shows an alternative core exercise device (100) that is substantially similar to core exercise device (10) described above, except with the differences elaborated below. In particular, core exercise device (100) includes a guide track assembly (160) having a curved body (162) defining an arched pathway (175) that forms a 360-degree loop, thereby providing the above-mentioned features.

Core exercise device (100) includes body engagement portion (20) and guide track assembly (160). An arched bridging member (50) connects top ends of frame members (30), which may provide further structural support between frame members (30). While in the current example, bridging member (50) is arched, this is merely optional. In some instances, bridging member (50) may be straight or otherwise shaped to provide back support should the user wish to rotate beyond a standard side plank position. In some aspects of the disclosure, bridging member (50) may be incorporated into body engagement portion (20) with guide track assembly (60).

Track assembly (160) includes an arched body (162) defining a circular opening (164). Arched body (162) also defines an arched pathway (175) that is substantially similar to arched pathway (75) described above, except arched pathway (175) forms a 360-degree loop. Therefore, arched pathway (175) suitably houses rotation support assemblies (40) of body engagement portion (20) such that body engagement portion (20) may rotate relative to guide track assembly (160) along a predetermined path provided by arched pathway (175). However, arched pathway (175) forms an annular loop such that rollers (44) never need to disengage with a roller floor of arched body (162). A user may also utilize device (100) to rotate body engagement portion (20) within track assembly (160) to achieve planking positions beyond side planks.

In some instances, it may be desirable to have a support frame attached to core exercise device (10, 100). Such a support frame may further stabilize device (10, 100) during illustrative use. Further, it may be desirable to have a feet-engagement station that may support the feet of a user during use of device (10, 100). Further, it may be desirable to have an adjustable feet-engagement station in order to accommodate various users having different anatomical dimensions. Such a feet-engagement station may also allow a user to rotate their feet in correspondence with the motion of their upper body during illustrative use of device (10, 100) in accordance with the description herein.

Figure 16:
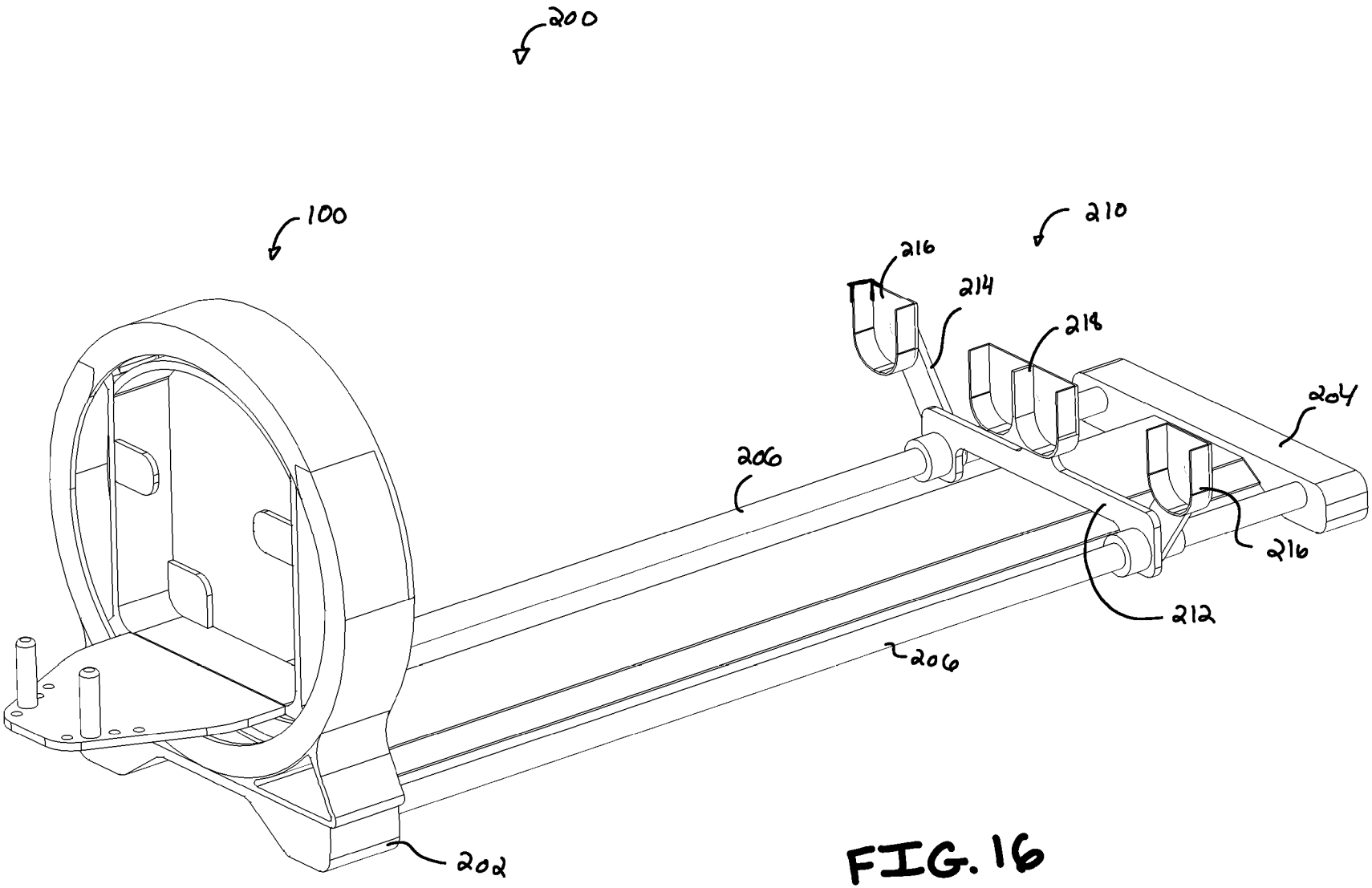
FIG. 16 depicts a perspective view of the core exercise device of FIG. 15 attached to a support frame assembly having an adjustable feet-engagement station.
Figure 17:
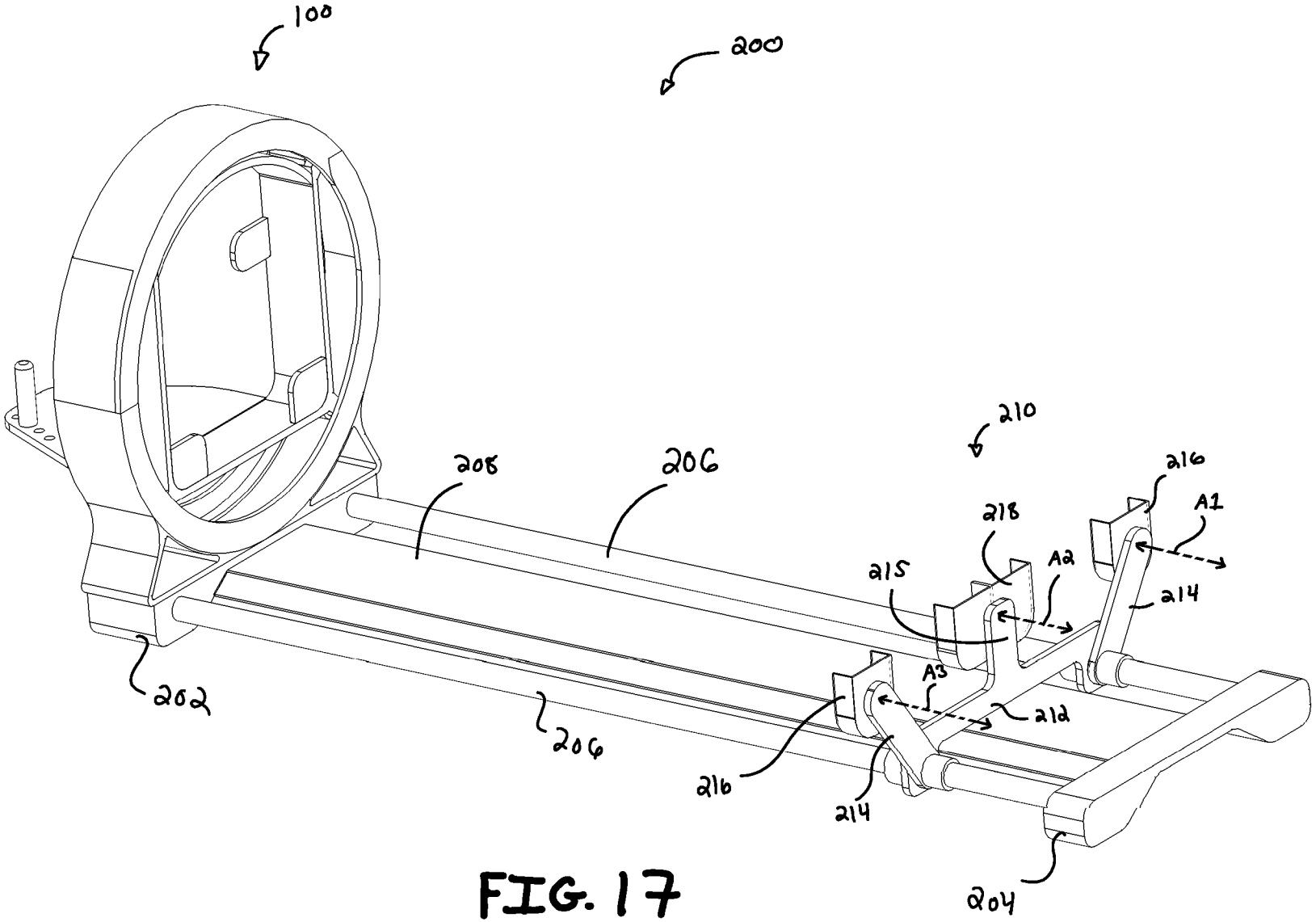
FIG. 17 depicts another perspective view of the core exercise device of FIG. 15 and the support frame assembly of FIG. 16.

FIGS. 16-17 show an illustrative support frame assembly (200) connected to device (100) described above. While support frame assembly (200) is shown connected to device (100) in the current aspect of the disclosure, it should be understood support frame assembly (200) may also be incorporated to device (10) described above, or any other suitable device as would be apparent to one skilled in the art in view of the teachings herein. Support frame assembly (200) includes a front base (202), a rear base (204), a pair of guide rails (206), a longitudinally extending body (208), and an adjustable feet-engagement station (210). Adjustable feet-engagement station (210) is configured to support the feet of user while their upper body engages device (100) to achieve a desired planking position.

Guide rails (206) and longitudinally extending body (208) are attached to both front base (202) and rear base (204), thereby providing sufficient structural rigidity to support frame assembly (200) and device (100) during example use in accordance with the description herein. Front base (202) is attached to device (100) such that front base (202) is interposed between the ground and device (100). Rear base (204) is configured to engage the ground in conjunction with front base (202) to further promote stability of frame assembly (200) during illustrative use of device (100) and frame assembly (200). Therefore, front base (202) and rear base (204) are configured to support a person utilizing the combination of device (100) and support frame assembly (200) in accordance with the description herein.

Feet-engagement station (210) includes a sliding frame (212), a pair of rotation arms (214), a central arm (215), a pair of wide feet-engagement bodies (216), and a central feet-engagement body (218). As will be described in greater detail below, feet-engagement bodies (216, 218) are configured to receive a foot of a user while the user achieves a planking position utilizing core exercise device (100) and support frame assembly (200). As will also be described in greater detail below, various features of feet-engagement station (210) are configured to adjust the spatial positioning of feet-engagement bodies (216, 218) relative to device (100) such that a user may customize where they place their feet during illustrative use of device (100) and frame assembly (200).

Guide rails (206) slidingly receive sliding frame (212) such that a user may adjust the longitudinal position of feet-engagement station (210) relative to device (100). Therefore, guide rails (206) support sliding frame (212). Sliding frame (212) is attached to rotation arms (214), central arm (215), and feet-engagement bodies (216, 218) such that movement of sliding frame (212) along the path defined by guide rails (206) causes arms (214, 216) and feet-engagement bodies (216, 218) to also actuate along the path defined by guide rails (206). Therefore, the distance between feet-engagement station (210) and device (100) may be selectively adjusted in order to accommodate for users having various heights.

Sliding frame (212) may include a locking assembly configured to selectively fix the longitudinal location of feet-engagement station (210) relative to guide rails (206). Therefore, once feet-engagement station (210) is positioned at a desired longitudinal location along guide rails (206), a user may lock the position of feet-engagement station (210) to inhibit the potential of accidental movement along guide rails (206) during illustrative use. Alternatively, sliding frame (212) may be configured to slide along the path of guide rails (206) during illustrative use such that a user may utilize their core to tuck their knees toward device (100) while maintain to plank position in accordance with the description herein.

Rotation arms (214) are configured to selectively rotate relative to a respective guide rail (206) about the longitudinal axis defined by guide rail (206). Wide feet-engagement bodies (216) are attached to a respective rotation arm (214) such that rotation of arm (214) about the long axis of guide rail (206) causes wide feet-engagement bodies (216) to also rotate relative to guide rails (206). Therefore, a user may rotate rotation arms (214) in order to position wide feet-engagement bodies (216) at a desired lateral and vertical position for use in accordance with the description herein. Wide feet-engagement bodies (216) may be positioned laterally away from each other such that a user may engage device (100) and support frame assembly (200) with their feet spaced away from each other. Therefore, a user may utilize rotation arms (214) and sliding frame (212) in order to place wide feet-engagement bodies (216) in a desired location relative to device (100) to achieve a desired wide-stance planking position.

Each wide feet-engagement body (216) is configured to receive and support a single foot such that a user may achieve a widened planking position while their upper body is suitably engaged with device (100). In some instances, wide feet-engagement bodies (216) may be configured to rotate relative to a respective rotation arm (214) about a respective axis (A1, A3). Such rotation of wide feet-engagement body (216) may allow a user to rotate their feet in correspondence with the motion of their upper body during illustrative use of device (10, 100) in accordance with the description herein. In some instances, wide feet-engagement bodies (216) may not be configured to rotate relative to a respective rotation arm (214) about a respective axis (A1, A3). In some instances, a user may be able to selectively lock and unlock the ability of wide feet-engagement body (216) from rotating about a respective axis (A1, A3).

While feet-engagement body (216) is shown as a generally U-shaped structure, feet-engagement body (216) may have any other suitable geometry in order to support a foot was would be apparent to one skilled in the art in view of the teachings herein.

In some instances, the length of rotation arms (214) extending from guide rails (206) may also be adjusted, which may give a user an extra degree of control when positioning wide feet-engagement bodies (216). Rotation arms (214) may be telescoping in nature in order to adjust their length. In some instance, wide-feet engagement bodies (216) may be configured to slide along the length of rotation arms (214) and lock into place to give a user an extra degree of control when positioning wide feet-engagement bodies (216).

Rotation arms (214) may each include a locking assembly configured to selectively fix the spatial position of a respective rotation arm (214) relative to sliding frame (212). Therefore, once rotation arm (214) is positioned at a desired spatial positioning, a user may lock the position of rotation arms (214) to inhibit the potential of accidental movement relative to sliding frame (212) during illustrative use.

While rotation arms (214) are used in the current example to adjust the vertical and lateral positioning of wide feet-engagement bodies (216) in the current example, it should be understood this is merely illustrative, as any suitable structure may be utilized as would be apparent to one skilled in the art in view of the teachings herein. For example, instead of having rotating arms (214), a board having generally planar surface, may extend upwardly from sliding frame (212) which may define a plurality of openings dimensioned to receive a coupling feature of a wide feet-engagement body (216) at various spatial positions relative to the rest of feet-engagement station (210). Therefore, a user may operatively attach wide feet-engagement body (216) to a desired position on the board via an opening to place wide feet-engagement body (216) at a desired spatial position.

Central arm (215) extends upwardly from sliding frame (212) and is operatively coupled with central feet-engagement body (218). Central feet-engagement body (218) is positioned at a lateral center of device (100) such that a user may hold their feet together while achieving a plank position. Central arm (215) may be configured to vertically extend and retract relative to sliding frame (212) into various vertical positions in order to vertically position central feet-engagement body (218) relative to device (100). Therefore, a user may extend/retract central arm (215) in order to position central feet-engagement body (218) at a desired vertical position for use in accordance with the description herein. Central arm (215) may extend and retract in the vertical direction utilizing any suitable structure as would be apparent to one skilled in the art in view of the teachings herein. For example, central arm (215) may be telescoping in nature. In some instance, central feet-engagement body (218) may be configured to slide along the length of central arm (215) and lock into place to give a user an extra degree of control when positioning central feet-engagement body (218).

Central feet-engagement body (218) is configured to receive and support both feet of a user such that the user may achieve a narrow planking position while their upper body is suitably engaged with device (100). In some instances, central feet-engagement body (218) may be configured to rotate relative to central arm (215) about a respective axis (A2). Such rotation of central feet-engagement body (218) may allow a user to rotate their feet in correspondence with the motion of their upper body during illustrative use of device (10, 100) in accordance with the description herein. In some instances, central feet-engagement body (218) may not be configured to rotate relative to central arm (215) about a respective axis (A2). In some instances, a user may be able to selectively lock and unlock the ability of central feet-engagement body (218) from rotating about a respective axis (A2).

While feet-engagement body (218) is shown as a generally U-shaped structure, feet-engagement body (218) may have any other suitable geometry in order to support both feet as would be apparent to one skilled in the art in view of the teachings herein.

Central arm (215) may include a locking assembly configured to selectively fix the spatial position of central arm (215) relative to sliding frame (212). Therefore, once central arm (215) is positioned at a desired spatial positioning, a user may lock the position of central arm (215) to inhibit the potential of accidental movement relative to sliding frame (212) during illustrative use.

While central arm (215) is used in the current example to adjust the vertical positioning of central feet-engagement body (218) in the current example, it should be understood this is merely illustrative, as any suitable structure may be utilized as would be apparent to one skilled in the art in view of the teachings herein. For example, instead of having central arm (215), a board having generally planar surface, may extend upwardly from sliding frame (212) which may define a plurality of openings dimensioned to receive a coupling feature of central feet-engagement body (218) at various spatial positions relative to the rest of feet-engagement station (210). Therefore, a user may operatively attach central feet-engagement body (218) to a desired position on the board via an opening to place central feet-engagement body (218) at a desired spatial position.

In some instances, support frame assembly (200) may provide sufficient stability during illustrative use in accordance with the description herein such that the use of grips (28) may be eliminated. In such instances, forearm support extension (24) may be designed for comfort or any other purpose as would be apparent to one skilled in the art in view of the teachings herein.

IV. MISCELLANEOUS

It should be understood that any one or more of the teachings, expressions, embodiments, examples, etc. described herein may be combined with any one or more of the other teachings, expressions, embodiments, examples, etc. that are described herein. The following-described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

It should be appreciated that any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

Illustrative Combinations

The following examples relate to various non-exhaustive ways in which the teachings herein may be combined or applied. It should be understood that the following examples are not intended to restrict the coverage of any claims that may be presented at any time in this application or in subsequent filings of this application. No disclaimer is intended. The following examples are being provided for nothing more than merely illustrative purposes. It is contemplated that the various teachings herein may be arranged and applied in numerous other ways. It is also contemplated that some variations may omit certain features referred to in the below examples. Therefore, none of the aspects or features referred to below should be deemed critical unless otherwise explicitly indicated as such at a later date by the inventors or by a successor in interest to the inventors. If any claims are presented in this application or in subsequent filings related to this application that include additional features beyond those referred to below, those additional features shall not be presumed to have been added for any reason relating to patentability.

Example 1

An exercise device, comprising: (a) a body engagement portion configured to support a user, wherein the body engagement portion comprises (i) a base surface configured to support a user in a standard plank position, and (ii) a rotation support assembly; and (b) a guide track assembly configured to rotationally house the body engagement portion such that the body engagement portion is configured to allow the user to rotate between a first side plank position, the standard plank position, and a second side plank position relative to a support surface while the guide track assembly remains in contact with the support surface and the body engagement portion supports the upper body of the user.

Example 2

The exercise device of claim 1, wherein the body engagement portion further comprises a first upwardly extending frame member and a second upwardly extending frame member, wherein the first upwardly extending frame member is attached to a first lateral side of the base surface, wherein the second upwardly extending frame member is attached to a second lateral side of the base surface.

Example 3

The exercise device of claim 2, wherein the base surface, the first upwardly extending frame member, and the second upwardly extending frame member together form a U-shape profile.

Example 4

The exercise device of claim 2, wherein the rotation support assembly comprises a first roller assembly associated with the first lateral side of the base surface, wherein the rotation support assembly comprises a second roller assembly associated with the second lateral side of the base surface.

Example 5

The exercise device of claim 4, wherein the rotation support assembly comprises as third roller assembly associated with a first top end of the first upwardly extending frame member, wherein the rotation support assembly comprises a fourth roller assembly associated with a second top end of the second upwardly extending frame member.

Example 6

The exercise device of claim 4, wherein the guide track assembly comprises a curved body defining an arched pathway, wherein the arched pathway of the curved body slidably houses the first roller assembly and the second roller assembly.

Example 7

The exercise device of claim 6, wherein the arched pathway extends along an annular loop.

Example 8

The exercise device of claim 6, wherein the curved body terminates at a first insertion opening and a second insertion opening.

Example 9

The exercise device of claim 4, wherein the first roller assembly comprises a yoke and a roller, wherein the roller extends along an axis, wherein the roller is configured to rotate relative to yoke about the axis.

Example 10

The exercise device of claim 2, wherein the body engagement portion further comprises a forearm support extension extending away from the base surface.

Example 11

The exercise device of claim 10, wherein the forearm support extension further comprises a pair of adjustable grips.

Example 12

The exercise device of claim 2, wherein the body engagement portion further comprises a pair of shoulder supports extending inwardly from the first upwardly extending frame member and the second upwardly extending frame member, respectively.

Example 13

The exercise device of claim 2, wherein the body engagement portion further comprises a pair of elbow supports extending inwardly from the first upwardly extending frame member and the second upwardly extending frame member, respectively.

Example 14

The exercise device of claim 1, wherein the guide track assembly comprises a base body, wherein the base body comprises a floor engagement surface configured to engage the support surface.

Example 15

The exercise device of claim 14, further comprise a feet-engagement station comprising a pair of feet-engagement bodies configured to support the feet of the user in the first side plank position, the standard plank position, and the second side plank position.

Example 16

The exercise device of claim 15, further comprising a frame member extending between the base body of the guide track assembly and the feet-engagement station.

Example 17

An exercise device, comprising: (a) a body engagement portion comprising: (i) a frame member configured to support a user, (ii) a rotation support assembly attached to the frame member; (b) a guide track assembly comprising: (i) a base body, and (ii) an arched body defining an arched pathway, wherein the rotation support assembly is slidably housed within the arched pathway and operatively engaged with the arched body such that the guide track assembly is configured to rotationally house the frame member, (c) a foot-engagement station; and (d) a frame coupling the foot-engagement station and the guide track assembly such that the foot-engagement station is adjustable relative to the guide track assembly, wherein the body engagement portion is configured rotate relative to the guide track assembly to allow the user to rotate between a first side plank position, the standard plank position, and a second side plank position relative to a support surface while the base body of the guide track assembly remains in contact with the support surface and the body engagement portion supports the upper body of the user.

Example 18

The exercise device of claim 17, wherein the frame comprises a first rail and a second rail, each slidably receiving the foot-engagement station.

Example 19

The exercise device of claim 17, wherein the arched body comprises an annular loop.

Example 20

An exercise device, comprising: (a) a body engagement portion comprising: (i) a U-shaped frame member configured to support a user, (ii) a rotation support assembly attached to the U-shaped frame member; and (b) a guide track assembly comprising: (i) a base body, and (ii) an arched body defining an arched pathway, wherein the rotation support assembly is slidably housed within the arched pathway and operatively engaged with the arched body such that the guide track assembly is configured to rotationally house the U-shaped frame member, wherein the body engagement portion is configured rotate relative to the guide track assembly to allow the user to rotate between a first side plank position, the standard plank position, and a second side plank position relative to a support surface while the base body of the guide track assembly remains in contact with the support surface and the body engagement portion supports the upper body of the user.

I claim:

1. An exercise device, comprising:

(a) a body engagement portion configured to support a user, wherein the body engagement portion comprises:
  (i) a base surface configured to support the user in a standard plank position, and
  (ii) a rotation support assembly; and (b) a guide track assembly configured to rotationally house the body engagement portion such that the body engagement portion is configured to allow the user to rotate between a first side plank position, the standard plank position, and a second side plank position relative to a support surface while the guide track assembly remains in contact with the support surface and the body engagement portion supports the upper body of the user.

2. The exercise device of claim 1, wherein the body engagement portion further comprises a first upwardly extending frame member and a second upwardly extending frame member, wherein the first upwardly extending frame member is attached to a first lateral side of the base surface, wherein the second upwardly extending frame member is attached to a second lateral side of the base surface.

3. The exercise device of claim 2, wherein the rotation support assembly comprises a first roller assembly associated with the first lateral side of the base surface, wherein the rotation support assembly comprises a second roller assembly associated with the second lateral side of the base surface.

4. The exercise device of claim 3, wherein the guide track assembly comprises a curved body defining an arched pathway, wherein the arched pathway of the curved body slidably houses the first roller assembly and the second roller assembly.

5. The exercise device of claim 4, wherein the arched pathway extends along an annular loop.

6. The exercise device of claim 4, wherein the curved body terminates at a first insertion opening and a second insertion opening.

7. The exercise device of claim 3, wherein the rotation support assembly comprises as third roller assembly associated with a first top end of the first upwardly extending frame member, wherein the rotation support assembly comprises a fourth roller assembly associated with a second top end of the second upwardly extending frame member.

8. The exercise device of claim 3, wherein the first roller assembly comprises a yoke and a roller, wherein the roller extends along an axis, wherein the roller is configured to rotate relative to yoke about the axis.

9. The exercise device of claim 2, wherein the body engagement portion further comprises a forearm support extension extending away from the base surface.

10. The exercise device of claim 9, wherein the forearm support extension further comprises a pair of adjustable grips.

11. The exercise device of claim 2, wherein the base surface, the first upwardly extending frame member, and the second upwardly extending frame member together form a U-shape profile.

12. The exercise device of claim 2, wherein the body engagement portion further comprises a pair of shoulder supports extending inwardly from the first upwardly extending frame member and the second upwardly extending frame member, respectively.

13. The exercise device of claim 2, wherein the body engagement portion further comprises a pair of elbow supports extending inwardly from the first upwardly extending frame member and the second upwardly extending frame member, respectively.

14. The exercise device of claim 1, wherein the guide track assembly comprises a base body, wherein the base body comprises a floor engagement surface configured to engage the support surface.

15. The exercise device of claim 14, further comprise a feet-engagement station comprising a pair of feet-engagement bodies configured to support the feet of the user in the first side plank position, the standard plank position, and the second side plank position.

16. The exercise device of claim 15, further comprising a frame member extending between the base body of the guide track assembly and the feet-engagement station.

17. An exercise device, comprising:

(a) a body engagement portion comprising:

(i) a frame member configured to support a user, (ii) a rotation support assembly attached to the frame member;

(b) a guide track assembly comprising:

(i) a base body, and (ii) an arched body defining an arched pathway, wherein the rotation support assembly is slidably housed within the arched pathway and operatively engaged with the arched body such that the guide track assembly is configured to rotationally house the frame member, (c) a foot-engagement station; and (d) a frame coupling the foot-engagement station and the guide track assembly such that the foot-engagement station is adjustable relative to the guide track assembly, wherein the body engagement portion is configured rotate relative to the guide track assembly to allow the user to rotate between a first side plank position, the standard plank position, and a second side plank position relative to a support surface while the base body of the guide track assembly remains in contact with the support surface and the body engagement portion supports the upper body of the user.

18. The exercise device of claim 17, wherein the frame comprises a first rail and a second rail, each slidably receiving the foot-engagement station.

19. The exercise device of claim 17, wherein the arched body comprises an annular loop.

20. An exercise device, comprising:

(a) a body engagement portion comprising:

(i) a U-shaped frame member configured to support a user, (ii) a rotation support assembly attached to the U-shaped frame member; and (b) a guide track assembly comprising:

(i) a base body, and (ii) an arched body defining an arched pathway, wherein the rotation support assembly is slidably housed within the arched pathway and operatively engaged with the arched body such that the guide track assembly is configured to rotationally house the U-shaped frame member, wherein the body engagement portion is configured rotate relative to the guide track assembly to allow the user to rotate between a first side plank position, the standard plank position, and a second side plank position relative to a support surface while the base body of the guide track assembly remains in contact with the support surface and the body engagement portion supports the upper body of the user.

* * * * *